US008861768B2

(12) United States Patent
Le Gette et al.

(10) Patent No.: US 8,861,768 B2
(45) **Date of Patent: *Oct. 14, 2014**

(54) EAR WARMER WITH A SPEAKER SYSTEM

(71) Applicant: 180s, Inc., Baltimore, MD (US)

(72) Inventors: Brian E. Le Gette, Baltimore, MD (US); David L. Reeb, Columbia, MD (US); Alan S. Tipp, Ellicott City, MD (US)

(73) Assignee: 180s, Inc., Baltimore, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/692,009

(22) Filed: Dec. 3, 2012

(65) Prior Publication Data

US 2013/0089230 A1 Apr. 11, 2013

Related U.S. Application Data

(60) Division of application No. 11/688,712, filed on Mar. 20, 2007, now Pat. No. 8,325,961, which is a continuation of application No. 10/638,553, filed on Aug. 12, 2003, now Pat. No. 7,212,645.

(51) Int. Cl.
*H04R 25/00* (2006.01)

(52) U.S. Cl.
USPC ..... 381/370; 381/301; 381/333

(58) Field of Classification Search
CPC ..... H04R 25/00
USPC ..... 381/301, 309, 333–334, 364, 367, 376, 381/388; 2/209, 905; 181/129; 379/430
See application file for complete search history.

(56) References Cited

U.S. PATENT DOCUMENTS

| | | | |
|---|---|---|---|
| 138,894 | A | 5/1873 | Isidor |
| 139,831 | A | 6/1873 | Stone |
| 170,942 | A | 12/1875 | Edgar |
| 183,359 | A | 10/1876 | Abbott |
| 184,006 | A | 11/1876 | Edgar |
| 185,506 | A | 12/1876 | Greenwood |
| 188,292 | A | 3/1877 | Greenwood |
| 190,720 | A | 5/1877 | Kleinert |

(Continued)

FOREIGN PATENT DOCUMENTS

| | | |
|---|---|---|
| CA | 2180036 | 1/1997 |
| CH | 294003 | 1/1954 |

(Continued)

OTHER PUBLICATIONS

Advertisement: The "PODZ" ear warming eye glass retainer, Shred Alert Products of Hood River, Oregon, 5 pgs.

(Continued)

*Primary Examiner* — Suhan Ni
(74) *Attorney, Agent, or Firm* — Cooley LLP

(57) ABSTRACT

A frame has an interior side and an exterior side. The frame is configured to extend around the back of a user's head. A first membrane is coupled to at least a portion of the interior side of the frame. In one embodiment, a second membrane is coupled to the first membrane. The first membrane and the second membrane define a receptacle and an opening that communicates with the receptacle. In one embodiment, a speaker is disposed in the receptacle. A first electrical wire has a first end electrically coupled to the speaker and a second end including a connector. The connector can be disposed proximate to the opening of the receptacle. The connector is configured to be electrically coupled to a second electrical wire.

20 Claims, 20 Drawing Sheets

(56) References Cited

U.S. PATENT DOCUMENTS

| | | | |
|---|---|---|---|
| 227,364 | A | 5/1880 | Kleinert |
| 315,233 | A | 4/1885 | Britton |
| 358,718 | A | 3/1887 | Basch |
| 359,425 | A | 3/1887 | Britton |
| 359,612 | A | 3/1887 | Kleinert |
| 360,985 | A | 4/1887 | Basch |
| 365,061 | A | 6/1887 | Friedman |
| 375,594 | A | 12/1887 | Basch |
| 381,559 | A | 4/1888 | Kleinert et al. |
| 486,725 | A | 11/1892 | Mellor |
| 503,703 | A | 8/1893 | Kleinert |
| 516,135 | A | 3/1894 | Thamm |
| 529,176 | A | 11/1894 | Kleinert |
| 548,738 | A | 10/1895 | Ballard |
| 758,680 | A | 5/1904 | Otte |
| 804,731 | A | 11/1905 | Keller |
| 836,087 | A | 11/1906 | Callahan |
| 869,741 | A | 10/1907 | Seitzman |
| 932,487 | A | 8/1909 | Melio |
| 953,623 | A | 3/1910 | Keller |
| 1,149,806 | A | 8/1915 | Basch |
| 1,167,368 | A | 1/1916 | Adams-Randall |
| 1,179,473 | A | 4/1916 | Taylor |
| 1,274,842 | A | 8/1918 | Basch |
| 1,326,875 | A | 12/1919 | Miller |
| 1,395,864 | A | 11/1921 | Pape |
| 1,398,958 | A | 12/1921 | Basch |
| 1,438,171 | A | 12/1922 | Delson |
| 1,567,105 | A | 12/1925 | Bohlman |
| 1,577,183 | A | 3/1926 | Dowiarz |
| 1,628,483 | A | 5/1927 | Wiegand et al. |
| 1,873,864 | A | 8/1932 | Ely |
| 1,945,110 | A | 1/1934 | Gordon |
| 1,988,880 | A | 1/1935 | Strouse |
| 2,070,216 | A | 2/1937 | Rosenberg |
| 2,120,189 | A | 6/1938 | Reinemer |
| 2,149,383 | A | 3/1939 | Bean |
| 2,184,996 | A | 12/1939 | Jacobs |
| 2,216,954 | A | 10/1940 | McDonough |
| 2,241,736 | A | 5/1941 | Reinemer |
| 2,246,031 | A | 6/1941 | Baritz et al. |
| 2,314,782 | A | 3/1943 | Goretsky |
| 2,333,392 | A | 11/1943 | Rosenzweig |
| 2,378,398 | A | 6/1945 | Fiedler |
| 2,405,326 | A | 8/1946 | Plotsky |
| 2,420,245 | A | 5/1947 | Hurst |
| 2,437,049 | A | 3/1948 | Salisbury et al. |
| 2,439,289 | A | 4/1948 | Fanslow |
| 2,447,078 | A | 8/1948 | Maxant |
| 2,464,331 | A | 3/1949 | Mason |
| 2,532,852 | A | 12/1950 | Oaks |
| 2,572,746 | A | 10/1951 | Mougel |
| 2,582,907 | A | 1/1952 | Kaufmann |
| 2,586,644 | A | 2/1952 | Gilbert |
| 2,609,544 | A | 9/1952 | Berg |
| 2,615,169 | A | 10/1952 | Maxant |
| 2,651,046 | A | 9/1953 | Berg |
| 2,671,221 | A | 3/1954 | Triplett |
| 2,678,999 | A | 5/1954 | Norris |
| 2,717,930 | A | 9/1955 | Hintz |
| 2,738,514 | A | 3/1956 | Gondell |
| 2,776,436 | A | 1/1957 | Berg |
| 2,782,423 | A | 2/1957 | Simon et al. |
| 2,858,544 | A | 11/1958 | Roth |
| 2,899,683 | A | 8/1959 | Wadsworth et al. |
| 2,946,860 | A | 7/1960 | Jansen et al. |
| 3,087,028 | A | 4/1963 | Bonnin |
| 3,104,398 | A | 9/1963 | Palmaer |
| 3,112,493 | A | 12/1963 | Greenberg |
| 3,119,119 | A | 1/1964 | Millinger et al. |
| 3,119,904 | A | 1/1964 | Anson |
| 3,156,923 | A | 11/1964 | Timm |
| 3,235,882 | A | 2/1966 | Coleman |
| 3,249,949 | A | 5/1966 | Rosenberg et al. |
| 3,308,480 | A | 3/1967 | Elder |
| 3,311,713 | A | 3/1967 | Knuebel |
| 3,440,663 | A | 4/1969 | Beguin |
| 3,447,160 | A | 6/1969 | Teder |
| 3,505,684 | A | 4/1970 | Hutchison et al. |
| 3,509,580 | A | 5/1970 | Rubenstein et al. |
| 3,686,691 | A | 8/1972 | Anderson |
| 3,721,993 | A | 3/1973 | Lonnstedt |
| 3,728,741 | A | 4/1973 | Lepor |
| 3,787,899 | A | 1/1974 | Krawagna |
| 3,815,155 | A | 6/1974 | Davison et al. |
| 3,841,325 | A | 10/1974 | Pickard |
| 3,944,018 | A | 3/1976 | Satory |
| 4,048,453 | A | 9/1977 | Seidel |
| 4,065,176 | A | 12/1977 | Fontana |
| 4,133,053 | A | 1/1979 | Lundin |
| 4,277,847 | A | 7/1981 | Florio |
| 4,349,081 | A | 9/1982 | Pepple |
| D266,417 | S | 10/1982 | Perez |
| 4,391,000 | A | 7/1983 | Lonnstedt |
| 4,404,434 | A | 9/1983 | Pelt et al. |
| 4,409,442 | A | 10/1983 | Kamimura |
| 4,445,005 | A | 4/1984 | Furuhashi |
| 4,455,457 | A | 6/1984 | Akira |
| 4,463,223 | A | 7/1984 | Yamanoi et al. |
| 4,471,496 | A | 9/1984 | Gardner, Jr. et al. |
| 4,486,903 | A | 12/1984 | Krystal |
| 4,499,593 | A | 2/1985 | Antle |
| 4,516,274 | A | 5/1985 | Buckland |
| 4,542,803 | A | 9/1985 | Houng |
| 4,546,215 | A | 10/1985 | Ferraro |
| 4,571,746 | A | 2/1986 | Gorike |
| 4,588,868 | A | 5/1986 | Bertagna et al. |
| 4,609,786 | A | 9/1986 | Omoto et al. |
| 4,615,185 | A | 10/1986 | Bollinger |
| 4,633,530 | A | 1/1987 | Satterfield |
| 4,654,898 | A | 4/1987 | Ishikawa |
| 4,660,229 | A | 4/1987 | Harris |
| 4,662,590 | A | 5/1987 | Hungerford, Jr. |
| 4,669,129 | A | 6/1987 | Chance |
| 4,670,911 | A | 6/1987 | Dunford |
| 4,682,374 | A | 7/1987 | Geiser |
| 4,713,843 | A | 12/1987 | Duncan |
| 4,727,599 | A | 2/1988 | Rappaport et al. |
| 4,747,145 | A | 5/1988 | Wiegel |
| 4,776,042 | A | 10/1988 | Hanson et al. |
| 4,776,044 | A | 10/1988 | Makins |
| 4,783,822 | A | 11/1988 | Toole et al. |
| 4,791,684 | A | 12/1988 | Schwartz |
| 4,796,307 | A | 1/1989 | Vantine |
| 4,802,245 | A | 2/1989 | Miano |
| 4,805,239 | A | 2/1989 | Ciago |
| D301,477 | S | 6/1989 | Storyk |
| 4,845,751 | A | 7/1989 | Schwab |
| 4,850,055 | A | 7/1989 | Hwang |
| 4,858,248 | A | 8/1989 | Goldsmith et al. |
| 4,864,619 | A | 9/1989 | Spates |
| 4,872,219 | A | 10/1989 | Duncan |
| 4,907,266 | A | 3/1990 | Chen |
| 4,918,757 | A | 4/1990 | Janssen et al. |
| 4,930,148 | A | 5/1990 | Lee |
| 4,969,069 | A | 11/1990 | Eichost |
| 4,982,451 | A | 1/1991 | Graham |
| 5,003,589 | A | 3/1991 | Chen |
| 5,033,094 | A | 7/1991 | Hung |
| 5,035,005 | A | 7/1991 | Hung |
| 5,038,412 | A | 8/1991 | Cionni |
| 5,046,192 | A | 9/1991 | Ryder |
| 5,052,194 | A | 10/1991 | Jarus |
| 5,056,161 | A | 10/1991 | Breen |
| 5,086,789 | A | 2/1992 | Tichy |
| 5,095,382 | A | 3/1992 | Abe |
| 5,113,428 | A | 5/1992 | Fitzgerald |
| 5,117,464 | A | 5/1992 | Jones et al. |
| 5,117,465 | A | 5/1992 | MacDonald |
| 5,164,987 | A | 11/1992 | Raven |
| 5,201,856 | A | 4/1993 | Edwards |
| 5,257,420 | A | 11/1993 | Byrne, Jr. |
| 5,265,165 | A | 11/1993 | Rauch |
| 5,285,530 | A | 2/1994 | Nardone, Jr |

(56) References Cited

U.S. PATENT DOCUMENTS

| | | | |
|---|---|---|---|
| 5,293,647 | A | 3/1994 | Mirmilshteyn et al. |
| D346,380 | S | 4/1994 | Fitzgerald |
| 5,303,426 | A | 4/1994 | Jones et al. |
| 5,327,178 | A | 7/1994 | McManigal |
| 5,339,467 | A | 8/1994 | Brinkley |
| 5,357,585 | A | 10/1994 | Kumar |
| 5,410,735 | A | 4/1995 | Borchardt et al. |
| 5,509,146 | A | 4/1996 | Bryerton, Sr. |
| 5,528,774 | A | 6/1996 | Sanders |
| 5,545,859 | A | 8/1996 | Ullrich |
| 5,551,089 | A | 9/1996 | Whidden |
| 5,551,090 | A | 9/1996 | Thompson |
| 5,567,038 | A | 10/1996 | Lary |
| D375,825 | S | 11/1996 | Whidden |
| 5,617,589 | A | 4/1997 | Lacore et al. |
| 5,625,903 | A | 5/1997 | Schultz et al. |
| 5,673,438 | A | 10/1997 | Lambert |
| 5,691,515 | A | 11/1997 | Landis |
| 5,708,725 | A | 1/1998 | Ito |
| D390,564 | S | 2/1998 | Savona |
| 5,718,001 | A | 2/1998 | Wright |
| 5,721,775 | A | 2/1998 | Leifer |
| 5,724,119 | A | 3/1998 | Leight |
| 5,749,099 | A | 5/1998 | Voorhees |
| 5,793,878 | A | 8/1998 | Chang |
| 5,821,468 | A | 10/1998 | Urella et al. |
| 5,835,609 | A | 11/1998 | LeGette et al. |
| 5,860,166 | A | 1/1999 | Ritts |
| 5,881,390 | A | 3/1999 | Young |
| 5,887,286 | A | 3/1999 | Waldron |
| 5,898,945 | A | 5/1999 | Weiser |
| 5,943,703 | A | 8/1999 | Avila, Jr. |
| 5,951,141 | A | 9/1999 | Bradley |
| 5,953,434 | A | 9/1999 | Boyden |
| 6,016,574 | A | 1/2000 | Chen |
| 6,029,282 | A | 2/2000 | Buschman |
| 6,055,672 | A | 5/2000 | Natvig |
| 6,065,157 | A | 5/2000 | Felman |
| 6,095,146 | A | 8/2000 | Knauer et al. |
| 6,104,824 | A | 8/2000 | Ito |
| 6,131,204 | A | 10/2000 | Otey |
| 6,148,446 | A | 11/2000 | Leight |
| 6,212,282 | B1 | 4/2001 | Mershon |
| 6,237,157 | B1 | 5/2001 | Lobbins |
| 6,319,015 | B1 | 11/2001 | Faunce |
| 6,332,223 | B1 | 12/2001 | LeGette et al. |
| 6,369,958 | B1 | 4/2002 | Himmele |
| 6,377,697 | B1 | 4/2002 | Cheng |
| 6,392,196 | B1 | 5/2002 | Lin |
| 6,406,811 | B1 | 6/2002 | Hall et al. |
| 6,499,146 | B2 | 12/2002 | Bavetta et al. |
| 6,502,247 | B2 | 1/2003 | LeGette et al. |
| 6,502,248 | B2 | 1/2003 | LeGette et al. |
| D473,539 | S | 4/2003 | O'Leary |
| 6,580,800 | B1 | 6/2003 | Yamasaki et al. |
| 6,678,897 | B2 | 1/2004 | Lindgren |
| 6,735,784 | B2 | 5/2004 | Isom et al. |
| 6,744,901 | B2 | 6/2004 | Ito et al. |
| 6,792,124 | B2 | 9/2004 | Tilbury et al. |
| 6,873,862 | B2 | 3/2005 | Reshefsky |
| 6,880,174 | B2 | 4/2005 | Prokop |
| 6,888,950 | B2 | 5/2005 | Siskin et al. |
| 6,918,678 | B2 | 7/2005 | McClanahan |
| 6,920,645 | B2 | 7/2005 | LeGette et al. |
| 6,965,681 | B2 | 11/2005 | Almqvist |
| 6,978,483 | B2 | 12/2005 | Isom et al. |
| 6,980,165 | B2 | 12/2005 | Yuasa et al. |
| 7,020,902 | B1 | 4/2006 | Tyler |
| 7,024,013 | B1 | 4/2006 | Van Dam et al. |
| 7,072,483 | B2 | 7/2006 | Lenhard-Backhaus |
| 7,114,823 | B2 | 10/2006 | McCullough et al. |
| 7,165,272 | B2 | 1/2007 | Hudson et al. |
| D541,482 | S | 4/2007 | Le Gette et al. |
| 7,210,173 | B2 | 5/2007 | Bavetta et al. |
| 7,212,645 | B2 | 5/2007 | Le Gette et al. |
| 7,222,373 | B2 | 5/2007 | Healy et al. |
| D545,001 | S | 6/2007 | Le Gette et al. |
| 7,318,654 | B2 | 1/2008 | McClanahan |
| 7,377,666 | B1 | 5/2008 | Tyler |
| 7,424,125 | B2 | 9/2008 | Amae et al. |
| 7,548,617 | B2 | 6/2009 | Yuen |
| 7,614,091 | B2 | 11/2009 | LeGette et al. |
| 7,617,543 | B2 | 11/2009 | LeGette et al. |
| 7,650,649 | B2 | 1/2010 | LeGette et al. |
| 7,962,970 | B2 | 6/2011 | LeGette et al. |
| 7,996,923 | B2 | 8/2011 | Isom et al. |
| 8,204,265 | B2 | 6/2012 | Siskin et al. |
| 8,325,961 | B2 | 12/2012 | Le Gette et al. |
| 8,438,666 | B2 | 5/2013 | LeGette |
| 8,443,466 | B2 | 5/2013 | Tipp |
| 2001/0017925 | A1 | 8/2001 | Ceravolo |
| 2002/0172390 | A1 | 11/2002 | Roberts |
| 2003/0037366 | A1 | 2/2003 | Lindgren |
| 2004/0252487 | A1 | 12/2004 | McCullough et al. |
| 2005/0028250 | A1 | 2/2005 | Zaic |
| 2005/0100184 | A1 | 5/2005 | Siskin et al. |
| 2005/0246815 | A1 | 11/2005 | LeGette et al. |
| 2005/0283882 | A1 | 12/2005 | Berger et al. |
| 2006/0000006 | A1 | 1/2006 | Gellis et al. |
| 2007/0042712 | A1 | 2/2007 | Yuen |
| 2007/0154029 | A1 | 7/2007 | Werner |
| 2007/0226876 | A1 | 10/2007 | Foust et al. |
| 2008/0044052 | A1 | 2/2008 | Whipple |
| 2008/0181429 | A1 | 7/2008 | Fried |
| 2008/0216214 | A1 | 9/2008 | Dolby |
| 2008/0279403 | A1 | 11/2008 | Pedersen et al. |
| 2008/0307563 | A1 | 12/2008 | Le Gette et al. |
| 2008/0307564 | A1 | 12/2008 | Le Gette et al. |
| 2008/0307565 | A1 | 12/2008 | Le Gette et al. |
| 2009/0010474 | A1 | 1/2009 | Ouryouji |
| 2009/0013447 | A1 | 1/2009 | Drosihn |
| 2009/0013448 | A1 | 1/2009 | Drosihn |
| 2009/0154740 | A1 | 6/2009 | Regen et al. |
| 2009/0196543 | A1 | 8/2009 | Lagakos et al. |
| 2009/0205110 | A1 | 8/2009 | Chiang |
| 2009/0285436 | A1 | 11/2009 | Lowry |

FOREIGN PATENT DOCUMENTS

| | | | |
|---|---|---|---|
| CH | 662052 | | 9/1987 |
| CN | 2291138 | | 9/1998 |
| CN | 2353337 | Y | 12/1999 |
| DE | 483279 | | 9/1929 |
| DE | 641554 | | 2/1937 |
| DE | 2516709 | | 10/1976 |
| DE | 3231218 | A1 | 2/1984 |
| DE | 4422767 | | 1/1996 |
| DE | 29800973 | | 3/1998 |
| DE | 29812652 | | 2/1999 |
| DE | 20003363 | | 8/2000 |
| EP | 126690 | | 11/1984 |
| EP | 0745364 | | 8/2002 |
| FR | 1353524 | | 1/1963 |
| FR | 2536253 | | 11/1982 |
| FR | 2538204 | | 12/1982 |
| FR | 2532838 | | 9/1983 |
| GB | 1327614 | | 8/1973 |
| GB | 2059206 | | 4/1981 |
| GB | 2062478 | | 5/1981 |
| GB | 2226931 | | 7/1990 |
| GB | 2290696 | | 1/1996 |
| GB | 2320885 | | 7/1998 |
| GB | 2339642 | | 2/2000 |
| JP | 47-19024 | | 11/1972 |
| JP | 48-75626 | | 9/1973 |
| JP | 53-143627 | | 11/1978 |
| JP | 54-168912 | U | 11/1979 |
| JP | 56-152479 | | 4/1981 |
| JP | 56-146719 | U | 11/1981 |
| JP | 56-164218 | U | 12/1981 |
| JP | 57-11884 | | 1/1982 |
| JP | 57-205216 | | 12/1982 |
| JP | 58-15618 | | 1/1983 |
| JP | 58-37289 | U | 3/1983 |

(56) References Cited

FOREIGN PATENT DOCUMENTS

| | | | |
|---|---|---|---|
| JP | 58-54191 | U | 4/1983 |
| JP | 58-104076 | | 7/1983 |
| JP | 58-138484 | | 9/1983 |
| JP | 58-182594 | U | 12/1983 |
| JP | 59-129815 | | 8/1984 |
| JP | 6029141 | | 2/1985 |
| JP | 60-244188 | | 12/1985 |
| JP | 61-42186 | | 3/1986 |
| JP | 62-3526 | | 1/1987 |
| JP | 62-21016 | | 2/1987 |
| JP | 63-20232 | | 6/1988 |
| JP | 1068506 | A | 3/1989 |
| JP | 1068508 | A | 3/1989 |
| JP | 1-125319 | | 8/1989 |
| JP | 1-125320 | U | 8/1989 |
| JP | 05-207581 | | 8/1993 |
| JP | 6-41720 | | 6/1994 |
| JP | 6-351090 | | 12/1994 |
| JP | 07-213403 | | 8/1995 |
| JP | 3039694 | U | 5/1997 |
| JP | 10-234039 | | 2/1998 |
| JP | 10-079994 | | 3/1998 |
| JP | 10-85251 | | 7/1998 |
| JP | 3053142 | U | 10/1998 |
| JP | 11-089699 | | 4/1999 |
| JP | 11-229223 | | 8/1999 |
| JP | 10257581 | | 8/2000 |
| JP | 3082758 | | 12/2001 |
| JP | 2002-11036 | | 1/2002 |
| KR | 200226271 | | 3/2001 |
| KR | 200314976 | | 6/2003 |
| KR | 300336877 | | 11/2003 |
| KR | 20357405 | | 7/2004 |
| KR | 20357406 | | 7/2004 |
| KR | 10/0703878 | | 4/2007 |
| SE | 452237 | | 11/1987 |
| WO | WO 92/17079 | | 10/1992 |
| WO | WO 94/02043 | | 2/1994 |
| WO | WO 94/09734 | | 5/1994 |
| WO | WO 97/48296 | | 12/1997 |
| WO | WO 98/07062 | | 2/1998 |
| WO | WO 98/31314 | | 7/1998 |
| WO | WO 01/76402 | | 10/2001 |
| WO | WO 02/083044 | | 10/2002 |
| WO | WO 03/086124 | | 10/2003 |
| WO | WO 2010/017359 | | 2/2010 |

OTHER PUBLICATIONS 1999-2000 Catalog "Accessory Goods"—Nitty Company, Ltd. 4 pgs.
Chicago Tribune article entitled "Winter From Head to Toe Lend an Ear to the Tale of This Intrepid Inventor," by Sid Moody, Feb. 16, 1988, 4 pgs.
"History of the United States Patent Office—The Patent Office Pony—A History of the Early Patent Office," by Kenneth W. Dobyns, 1994, [Introductory Material—3 pgs; Chapter 29—4 pgs; and Sources and Annotations—40 pgs.].
2003 Catalog, "Join the Polar Fusion Revolution; Revolutionary Ear Warmers," Polar Fusion LLC.—2 pgs.
Nitty Company Ltd. Winter '89-'90 catalog, 6 pages.
Nitty Company Ltd. Winter '90-'91 catalog, 4 pages.
"Hearmuff: Fleece headwear with internal stereo headphones" from http://www.hearmuff.com/index.htm, 2003, 3 pgs.
Opinion from the District Court of Maryland in *180s, Inc. and 180s, LLC* v. *Gordini U.S.A., Inc.* (Case 1:08-cv-00177-JFM), 23 pages, dated Mar. 30, 2010.
Defendant Gordini's First Supplemental and Amended Answers and Objections to Plaintiffs Second Set of Interrogatories (Non-Confidential Version) from *180s, Inc. and 180s, LLC* v. *Gordini U.S.A., Inc.* (Case 1:08- cv-00177-JFM), 29 pages, dated Feb. 4, 2009.
Photographs of Yukon Cornellieus Product, undated, 3 pages.
Supplementary European Search Report from EP Application No. EP 04801908, 5 pages, dated Apr. 24, 2009.
International Search Report for PCT/US2004/025785, 5 pages, dated Sep. 22, 2008.
International Search Report and Written Opinion for International Application No. PCT/US2012/049326, mailed Nov. 16, 2012.
Partial Search Report for European Patent Application No. 13 169 329.3, mailed Jul. 24, 2013.
Extended Search Report for European Patent Application No. 13 169 329.3, mailed Nov. 18, 2013.
Office Action for Canadian Patent Application No. 2,768,889, mailed Feb. 4, 2014.
International Preliminary Report on Patentability for International Patent Application No. PCT/US2012/049326, mailed Feb. 4, 2014.
Case 1:08-cv-00177-JFM, Document 126, Rebuttal Claim Construction Brief of Plaintiffs 180s, Inc. and 180s, LLC, U.S. District Court District of Maryland, Baltimore Division, Mar. 2, 2012.
Case 1:08-cv-00177-JFM, Document 141, Opinion, U.S. District Court for the District of Maryland, Mar. 30, 2012.
Case 1:08-cv-00177-JFM, Document 113, Opening Claim Construction Brief of Plaintiffs 180s, Inc. and 180s, LLC, U.S. District Court, District of Maryland, Baltimore Division, Feb. 16, 2010.
Case 1:08-cv-00177-JFM, Document 114, Defendant Gordini's Initial Markman Claim Construction Brief, U.S. District Court, District of Maryland, Baltimore Division, Feb. 16, 2010.
Case 1:08-cv-00177-JFM, Document 127, Defendant Gordini's Response to 180s' Initial Markman Claim Construction Brief, U.S. District Court, District of Maryland, Baltimore Division, Mar. 2, 2010.
Case 1:08-cv-00177-JFM, Document 129, Joint Claim Construction Statement, U.S. District Court, District of Maryland, Baltimore Division, Mar. 5, 2010.

EAR WARMER WITH A SPEAKER SYSTEM

CROSS-REFERENCES TO OTHER APPLICATIONS

This application is a divisional of U.S. patent application Ser. No. 11/688,712, filed Mar. 20, 2007, which is a continuation of U.S. patent application Ser. No. 10/638,553 (now U.S. Pat. No. 7,212,645), filed Aug. 12, 2003, each entitled "Ear Warmer With a Speaker System," the disclosures of each of which are incorporated herein by reference in their entirety. This application is related to U.S. patent application Ser. No. 10/638,554 (now U.S. Pat. No. 7,222,373) entitled "Ear Warmer Having a Membrane Forming a Receptacle," filed Aug. 12, 2003 and U.S. patent application Ser. No. 10/638,476 (now U.S. Pat. No. 7,650,649) entitled "Ear Warmer Having an External Frame," filed Aug. 12, 2003, the disclosures of each of which are incorporated herein by reference in their entirety.

BACKGROUND

The invention relates to ear warmers, and more particularly to an ear warmer that includes speakers coupled thereto.

Ear warmers have been provided that are designed to cover an individual's ears to maintain warmth. Many such ear warmers include bands that extend over the head of the user that can be uncomfortable and cumbersome for the user. In addition to ear warmers, headphones that are configured to be coupled to sound devices are commonly used. A problem arises when individuals wear traditional headphones with various ear warmers. For example, headphones interfere with the band of traditional ear warmers and also interfere with the ear warmers themselves.

In addition, headphones have long wires that hang from the ear warmer and are both uncomfortable and unattractive.

Thus, there is a need for an ear warmer that includes headphones that are effectively coupled with the ear warmer and that provide for a connection to a sound device that is not cumbersome for the wearer.

SUMMARY OF THE INVENTION

A frame has an interior side and an exterior side. The frame is configured to extend around the back of a user's head. A first membrane is coupled to at least a portion of the interior side of the frame. In one embodiment, a second membrane is coupled to the first membrane. The first membrane and the second membrane define a receptacle and an opening that communicates with the receptacle. In one embodiment, a speaker is disposed in the receptacle. A first electrical wire has a first end electrically coupled to the speaker and a second end including a connector. The connector can be disposed proximate to the opening of the receptacle. The connector is configured to be electrically coupled to a second electrical wire.

DETAILED DESCRIPTION

Several embodiments of an ear warmer or ear covering are shown in FIGS. 1-26. A general and functional description of an ear covering with a speaker is presented first, followed by a description of various implementations.

Figure 1:
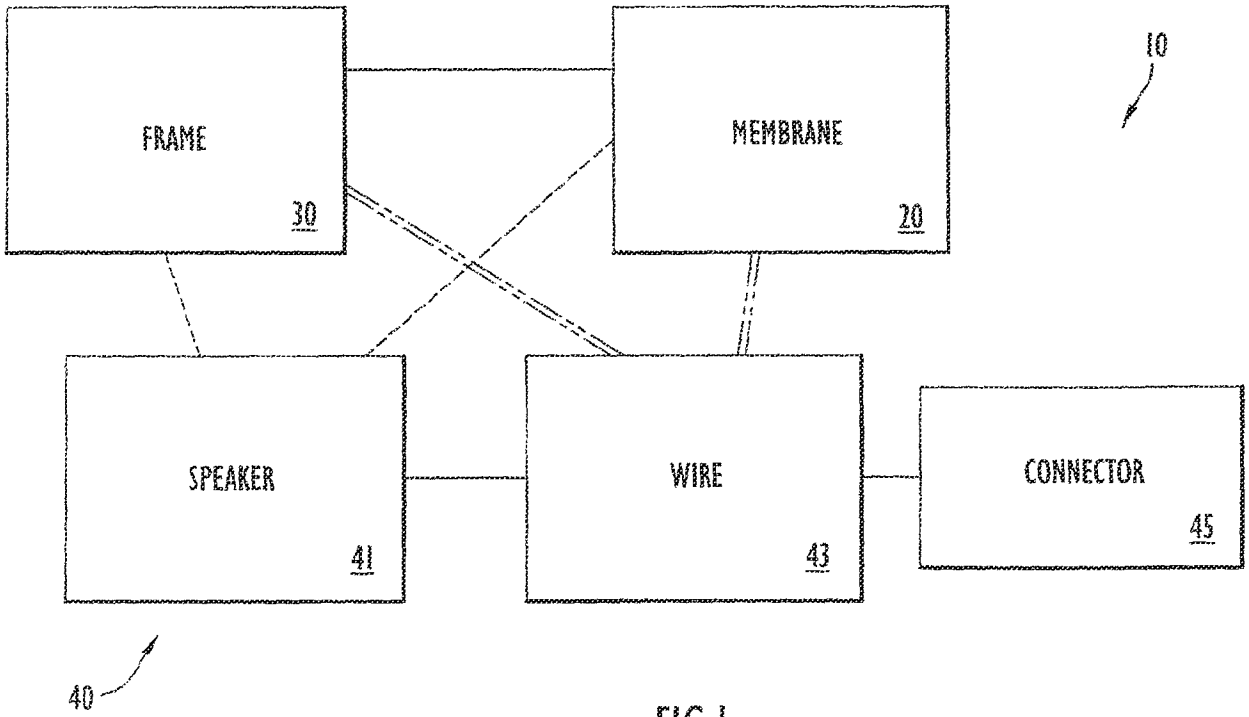
FIG. 1 is a schematic illustration of an ear covering with a speaker according to an embodiment of the invention.

FIG. 1 is a schematic illustration of an ear covering 10, which includes a frame 30 and a membrane 20 coupled to the frame 30. As shown in FIG. 1, certain components of the ear covering can be coupled to other components. The types of couplings are represented by the different types of lines: the straight lines represent fixed or removable couplings, and the dashed lines represent optional couplings.

The membrane 20 can be removably or fixedly coupled to the frame 30. In one embodiment, the ear covering 10 includes a speaker assembly 40. The speaker assembly 40 includes a speaker 41, a wire 43 and a connector 45. The speaker 41 can be coupled to the frame 30 or the membrane 20. Similarly, the wire 43 can be coupled to frame 30 or the membrane 20. In an alternative embodiment, only one of the speaker and the wire is not coupled to the frame 30 or the membrane 20. The ear covering 10 is configured to be worn such that the user's ears are substantially covered by the ear covering 10.

While not illustrated as such in FIG. 1, the ear covering 10 need not include the frame 30. In such an embodiment, the speaker 41 and/or the wire 43 can be coupled to the membrane 20. One example of an embodiment without a frame is two separate structures each of which covers a separate ear of a user.

Examples of ear covering embodiments are now described with reference to FIGS. 2-26. In one embodiment, illustrated in FIG. 2, ear covering 100 includes a membrane or covering 200 that has an interior region that includes receptacles 220 and an opening 230 defined to provide access to the receptacle 220. The ear covering 100 includes a frame (not shown in FIG. 2) a portion of which that is configured to be disposed in and support the membrane 200.

Figure 3:
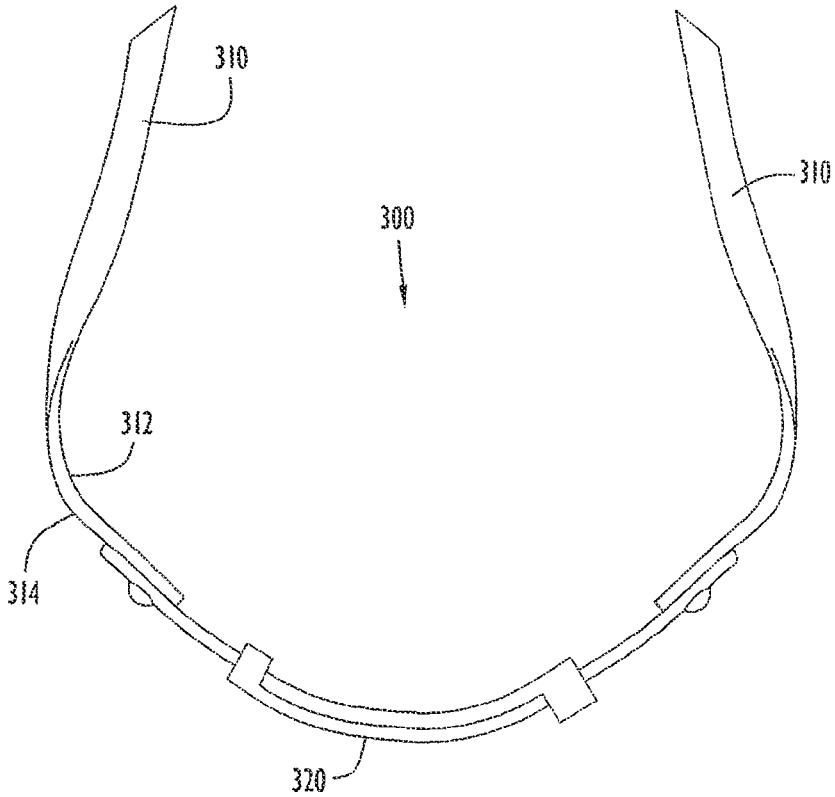
FIG. 3 is a top view of a frame for use with an ear covering with a speaker according to embodiment of the invention.

Examples of frames for use with the ear covering 100 (and other embodiments described herein) are illustrated in FIGS. 3-7. As illustrated in FIG. 3, frame 300 includes two ear cups 310 that are pivotally coupled to an adjustable band 320. The adjustable band 320 includes a first portion and a second portion that is slidably coupled to first portion. Each ear cup 310 defines an opening 315 (see FIG. 4) and is configured to substantially surround the ear of the user. While the opening 315 provides a desirable fit for the user and does not interfere with sound passing through the ear covering, the ear cups 310 could alternatively be of a solid construction or could have slots or similar openings defined therein. The ear cup 310 includes an interior side 312 and an exterior side 314. The interior side 312 is that side closest to the user's head when the ear covering 100 is being worn. A detailed discussion of an ear covering frame for use with the invention is included in U.S. Pat. No. 5,835,609, the disclosure of which is incorporated herein by reference in its entirety.

Figure 5:
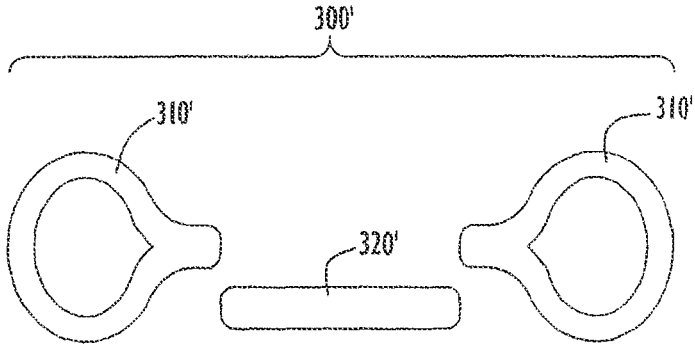
FIG. 5 is an exploded view of an alternative embodiment of a frame for use with an ear covering with a speaker according to an embodiment of the invention.
Figure 6:
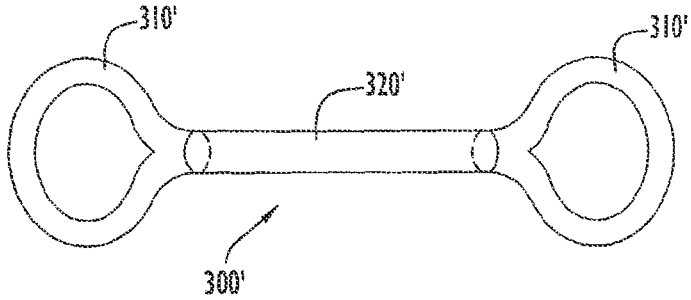
FIG. 6 is a plan view of the frame illustrated in FIG. 5 assembled.

An alternative frame 300' for use with an ear covering is illustrated in FIGS. 5 and 6. In this embodiment, the frame 300' includes ear cups 310' and a band 320' to which the ear cups 310' are coupled. The ear cups 310' can be coupled to the band 320' using any conventional technique or device, including connectors such as rivets or screws. This frame 310' can have a curved cross-section similar to a frame described in U.S. patent application Ser. No. 10/056,093, filed on Jan. 28, 2002, now U.S. Pat. No. 6,735,784, issued on May 18, 2004, the disclosure of which is incorporated herein by reference in its entirety.

Any adjustable or non-adjustable frame can be used with the ear covering according to the invention includes any adjustable or non-adjustable frames. Moreover, monolithic frames as well as frames that include two or more physically distinct members or parts can be used.

Figures 7A, 7B:
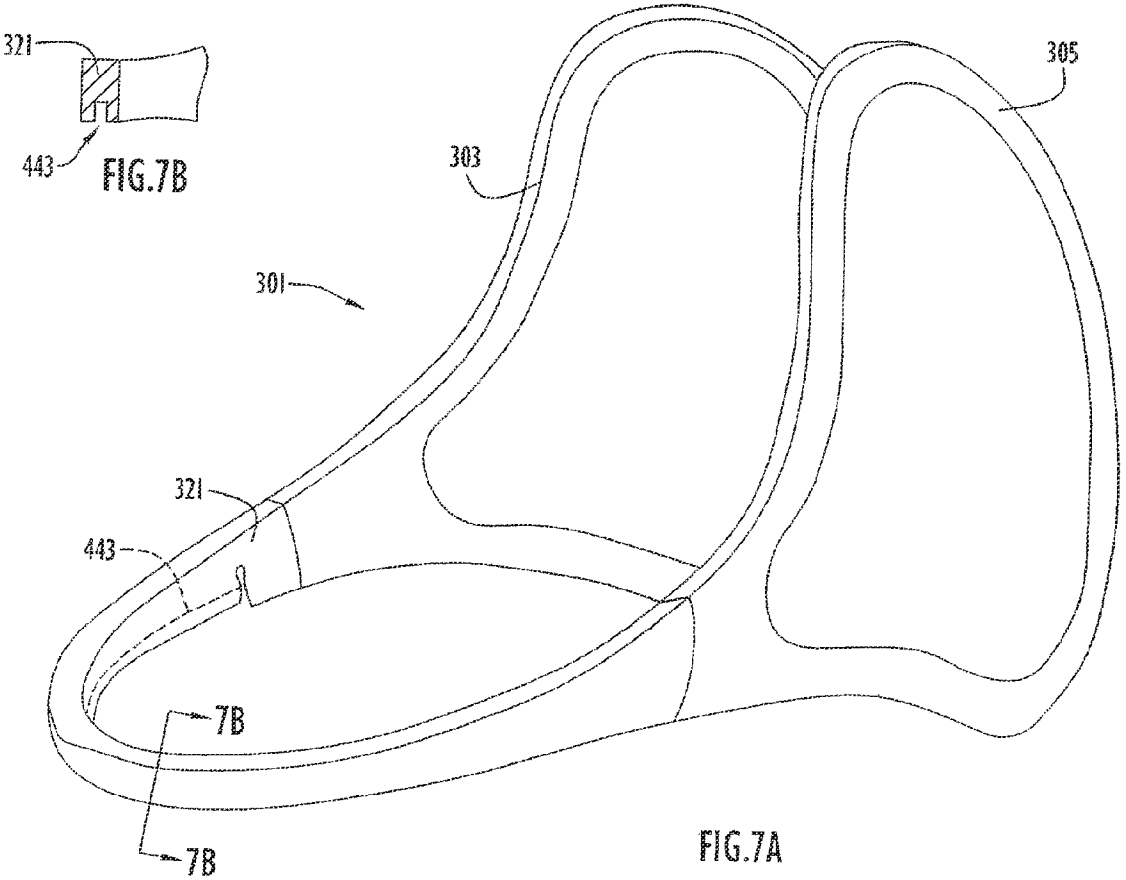
FIG. 7A is a perspective view of an alternative embodiment of a frame for use with an ear covering with a speaker according to an embodiment of the invention.
FIG. 7B is a cross-section view of a portion of the frame of FIG. 7A taken along line 7B-7B.

An alternative embodiment of a frame is illustrated in FIGS. 7A and 7B. In this embodiment, frame 301 includes a first ear portion 303, a second ear portion 305 and a band portion 321 coupled to the ear portions 303 and 305. The ear portions 303 and 305 are pivotally coupled to the band portion 321. In alternative embodiments, the ear portions 303 and 305 can be fixedly coupled to the band portion 321 or even formed monolithically with the band portion 321. FIG. 7B is a cross-sectional view of the frame illustrated in FIG. 7A taken along line 7B-7B.

Figure 8:
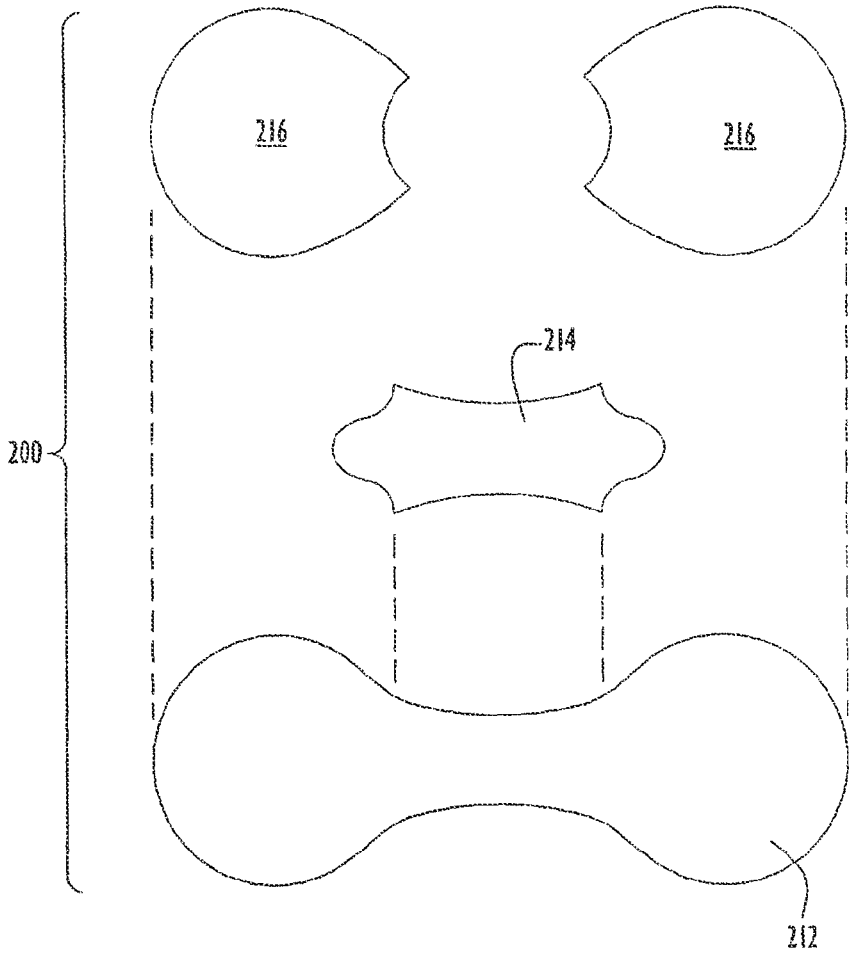
FIG. 8 is an exploded view of an embodiment of a membrane for use with an ear covering according to an embodiment of the invention.

Turing to the membrane, the membrane 200 can be removably coupled to any frame. Referring to FIG. 8, one embodiment of a membrane 200 is illustrated. In this embodiment, the membrane 200 includes an exterior portion 212, a central interior portion 214 and interior end portions 216. In one embodiment, each of the interior end portions 216 is coupled to exterior portion 212 substantially about the portion of their perimeters that correspond to a portion of the perimeter of exterior portion 212. In other words, the perimeter portion of interior end portions 216 are not completely sewn to the exterior portion 212 thereby defining opening 230 (see FIG. 2) and defining the receptacle 220 between the exterior portion 212 and each interior end portion 216. In this embodiment, opening 230 provides access to receptacle 220. Note that the term "perimeter portion" is intended to include the perimeter of a membrane or member as well as any portion offset from and proximate to the perimeter.

Figure 2:
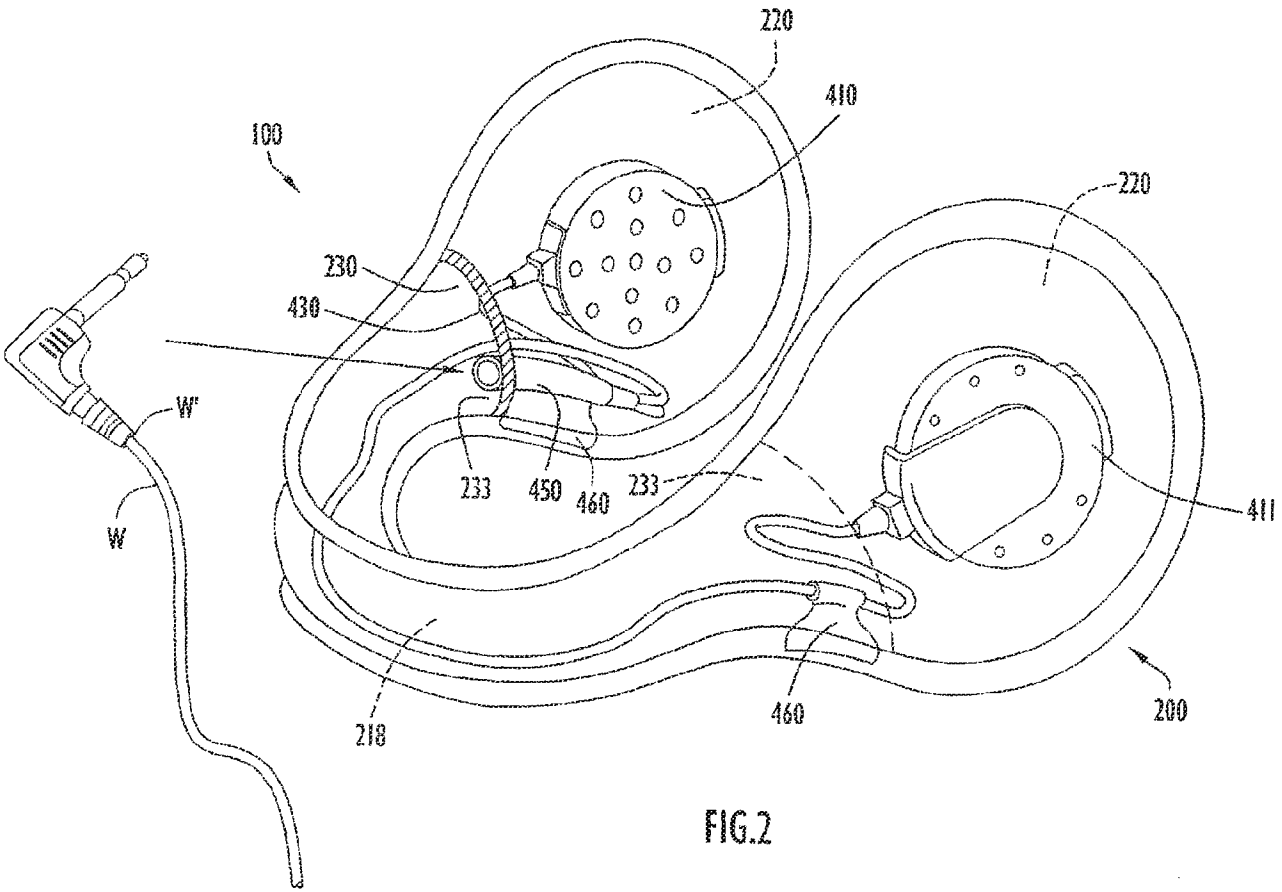
FIG. 2 is a perspective view of an ear covering with a speaker according to an embodiment of the invention.
Figure 4:
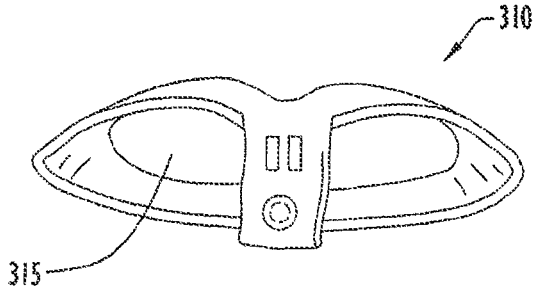
FIG. 4 is a perspective view of a component of the frame illustrated in FIG. 3.

Similarly, the central interior portion 214 can be sewn partially along its perimeter to define a receptacle 218 between the central interior portion 214 and the exterior portion 212 (see FIG. 2). Openings 233 are defined at each end of the receptacle 218 and can coincide with openings 230. Alternatively, the openings of the receptacle 218 can be offset from the openings 230. In one embodiment, the receptacles 220 and 218 may be considered to be a single receptacle defined between the exterior portion 212 and the interior portions 214, 216 and 218.

Figure 9:
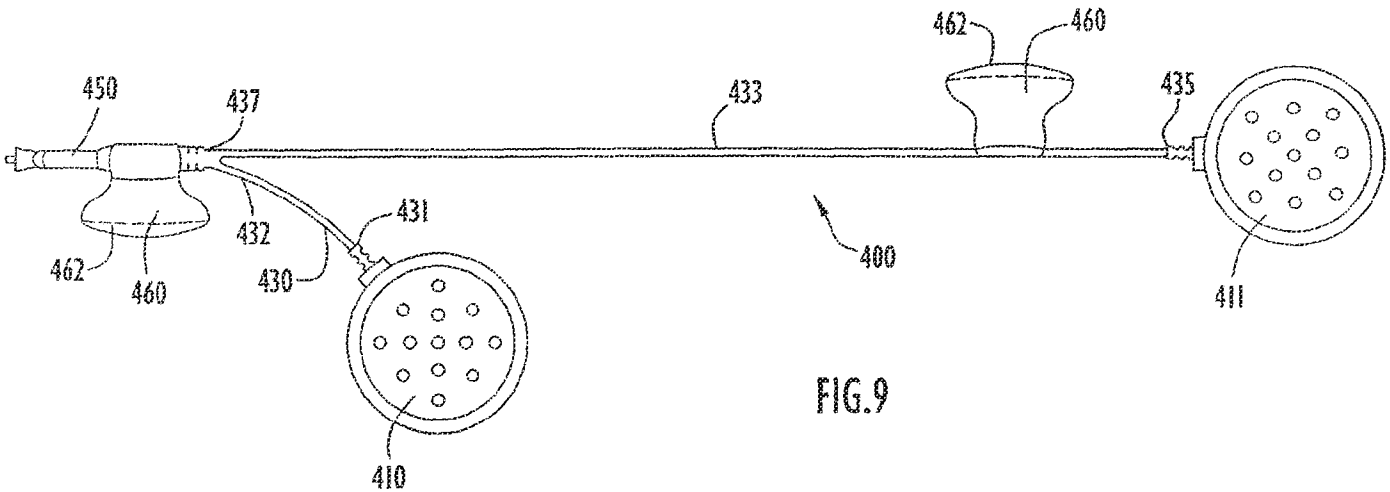
FIG. 9 is a plan view of a speaker system for use with an ear covering according to an embodiment of the invention.
Figure 10:
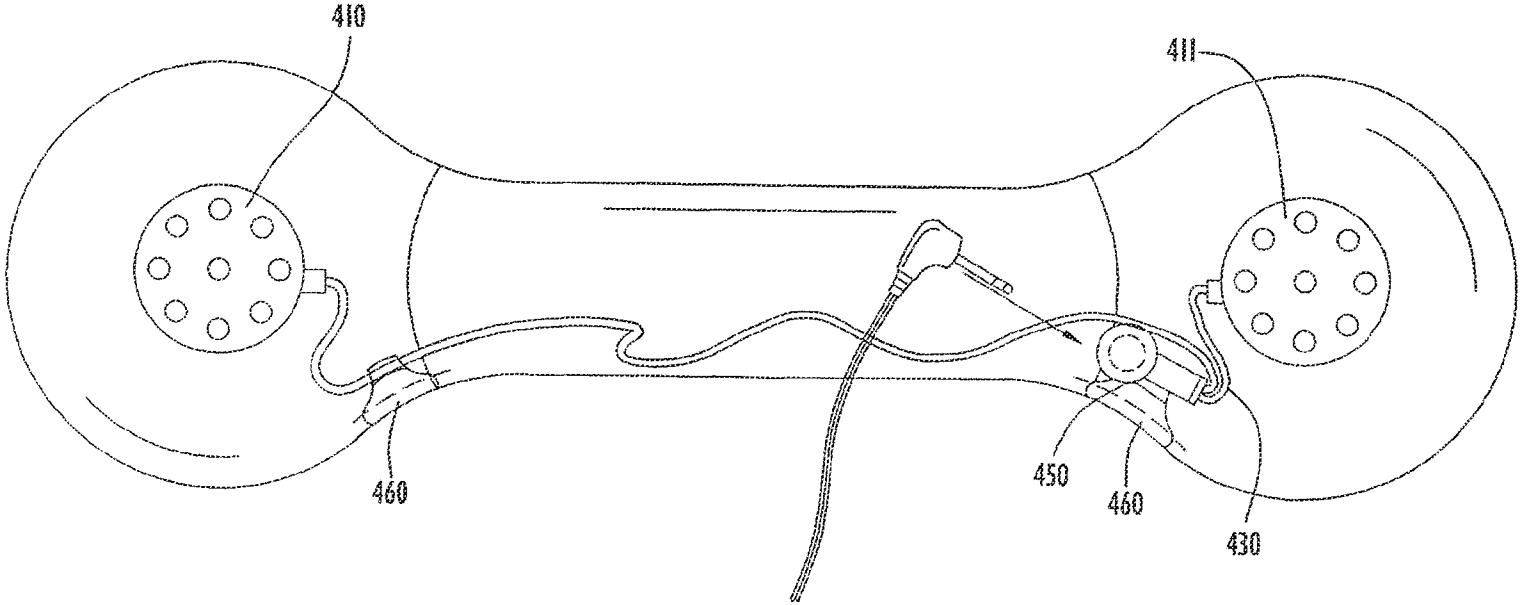
FIG. 10 is a partial cross-sectional view of the ear covering illustrated in FIG. 2.

An example of a speaker system for use with an ear covering is illustrated in FIG. 9. The speaker system 400 can be coupled to the membrane 200 (as illustrated in FIG. 2) or, alternatively, can be coupled to the frame. The speaker system 400 includes a first speaker 410, a second speaker 411, a first wire 430, a second wire 433, and a connector 450. The receptacles 220 defined in the membrane 200 are configured to receive speakers 410 and 411 as illustrated in FIG. 2. The receptacle 218 defined within the membrane 200 is configured to receive at least a portion of the second wire 433 as illustrated in FIGS. 2 and 10.

Wire 430 includes a first end 431 that is coupled to the first speaker 410 and a second end 432 that is coupled to the connector 450. Similarly, wire 433 includes a first end 435 that is coupled to the second speaker 411 and a second end 437 that is coupled to the connector 450. In an alternative embodiment, one of the wires extends from the first speaker to the second speaker and then to the connector.

In one embodiment, the connector 450 is disposed proximate to the opening 230. In one embodiment, a distance between the first speaker 410 and the connector 450 is not greater than half of the length of the ear covering 100. Thus, the wire 430 can be configured such that it has a length of wire no more than half of the length of the ear covering 100. This distance allows the connector 450 to be easily stored within the ear covering 100 when not in use. The distance between the speaker 410 and the connector 450 is determined by the length of the wire 430. For example, the connector 450 can be disposed within a receptacle of the ear covering 100 such that the connector 450 is not visible and is not in direct contact with the user. Alternatively, in the event the connector is not stored, the shorter length of the wire will not render it cumbersome to the user. In an alternative embodiment, the length of the wire is more than half of the length of the ear covering.

The connector 450 can be either a male or female connector and is configured to be coupled to another wire as illustrated, for example, by the wire W in FIG. 2. Note that connector 450 is illustrated as a female connector in FIG. 2 and as a male connector in FIG. 9. The wire W includes a first end W' that is configured to be electrically coupled to the speaker system 400 via connector 450. The first end W' may be configured with an opposing connector that can mate with connector 450. Wire W has a second end (not shown) that is configured to be coupled, either fixedly or removably, to a device (not shown) associated with sound generation. The wire W is disposed outside of the sound-generation device. Examples of the devices to which the speaker system 400 may be electrically coupled include portable radios, cellular phones, MP3 players (MPEG audio layer 3), portable CD (compact disk) players, audio amplifiers, and the like.

In the embodiment illustrated in FIGS. 2, 9, and 10, one or more tabs 460 can be coupled to the speaker system 400. The tabs 460 are configured to couple the speaker system 400 to the membrane 200 and/or the frame 300. The tabs 460 are constructed as substantially thin flexible members and can be coupled to the membrane 200, for example, by being sewn within the same seam that couples the portions of the membrane 200. In one embodiment, the tabs 460 can have a substantially tear-drop shaped configuration (i.e., the thickness of the tab 460 decreases as it extends away from the wire or other component of the speaker system to which it is coupled. In this manner, the tab 460 provides a rigid support, yet is flexible enough to allow it to deform slightly so that the tab 460 does not interfere with the user. The tab is also thin enough at or near its outer edge so that it can be easily sewn or otherwise coupled to the ear covering. For example, the tab 460 can be sewn along the dashed line 462 illustrated in FIG. 9. In the embodiment illustrated in FIG. 2, the tabs 460 are sewn or coupled along the seam around the perimeter portion of the membrane 200. Alternatively, the tabs 460 can be sewn to any part of membrane 200. A tab 460 can be coupled to the connector 450 as illustrated in FIGS. 2 and 9, thereby securing the connector 450 to the membrane 200 or the frame 300. In alternative embodiments, the tabs 460 can have any shape or configuration.

Figure 18:
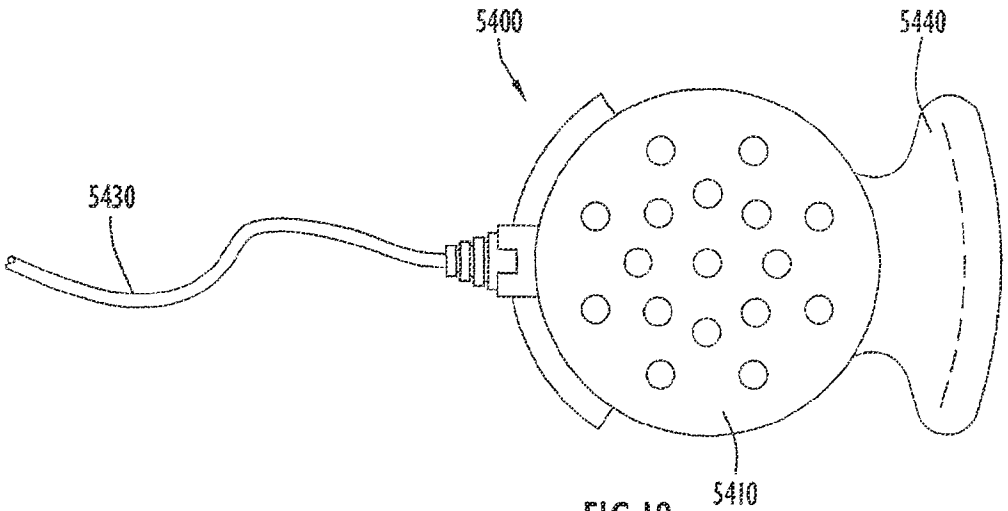
FIG. 18 is a plan view of a speaker for use with an ear covering according to an embodiment of the invention.
Figure 19:
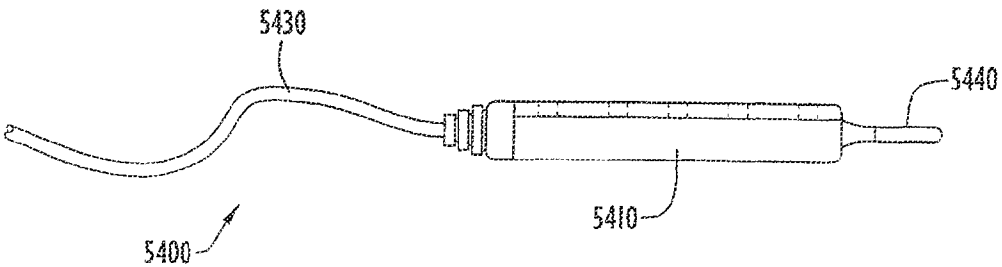
FIG. 19 is a side view of the speaker illustrated in FIG. 18.

An alternative speaker assembly is illustrated in FIGS. 18 and 19. The speaker assembly 5400 includes a speaker 5410, a wire 5430, a connector (not shown) and a tab 5440. In this embodiment, tab 5440 is coupled to the speaker 5410 and can be coupled to the membrane 200 as described above. The tab can be removably or fixedly coupled to the speaker and/or the membrane. In an alternative embodiment, the tab is coupled to the speaker and to the frame. In another embodiment, the tab can be integrally formed with the speaker.

Figure 19A:
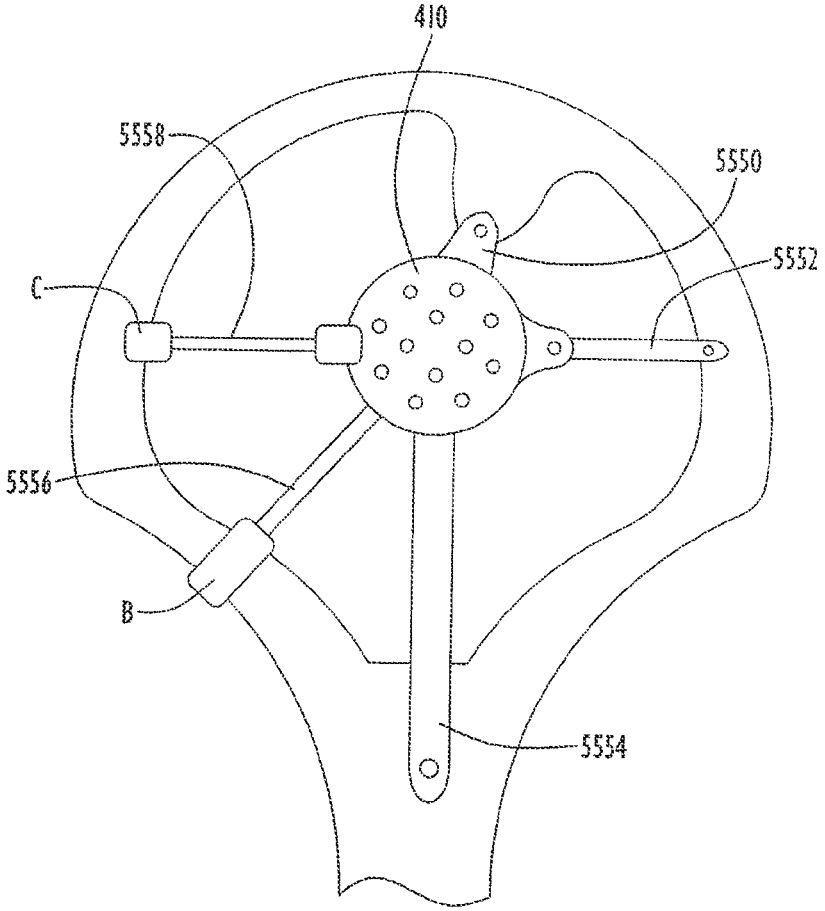
FIG. 19A is a perspective view of a an alternative embodiment portion of an ear covering according to an embodiment of the invention.

Although the speaker assembly has been discussed as being coupled to the frame and the membrane of the ear covering, the speaker assembly may be coupled to any portion of the frame. FIG. 19A illustrates several examples of locations along the frame where the speaker may be coupled. The various techniques and structures illustrated can be used in combination or separately in the alternative to couple a speaker to a frame portion. For example, the speaker 410 may be coupled to the frame via a coupler, such as couplers 5550, 5552, and 5554. Coupler 5550 is coupled to speaker 410 and coupled to an extension of the frame by a connector, such as a rivet. Alternatively, coupler 5552 can be coupled to an extension 5556 of the speaker 410. Alternatively, the speaker may be coupled to the frame via a clip or other snap-like structure such as illustrated at connection B or connection C. One end of the coupler 5556 is removably coupled to the frame, and one end of coupler 5558 is removably coupled to the speaker and the other end of coupler 5558 is removably coupled to the frame. Additionally, the speaker may be coupled directly to the frame or an intermediate member may be coupled between the speaker and the frame. Although FIG. 19A illustrates the speaker as being coupled via the several methods, the speaker need only be coupled via one of the techniques. In an alternative embodiment, the speaker is coupled to the frame at several locations and via different techniques.

Returning to FIG. 9, the wires 430 and 433 and/or the connector 450 can be coupled to the frame member 300. For example, as illustrated in FIGS. 7A and 7B, the band portion 321 of the frame 301 includes a groove 443 that extends along a portion of the band 321. The groove 443 is formed in the lower surface of the band portion 321. In this example, the wires 430 and 433 can be disposed within the groove 443. Additionally, in the embodiment illustrated in FIGS. 7A and 7B, a heat-retaining material (not illustrated) may be coupled to a portion of the frame 301, such as an ear portion.

Alternatively, the wires, the connector, the speaker, or any combination thereof can be coupled to the frame 300 by being glued, RF welded, sonically welded, taped, clipped, etc., as will be discussed in greater detail below.

Figure 11:
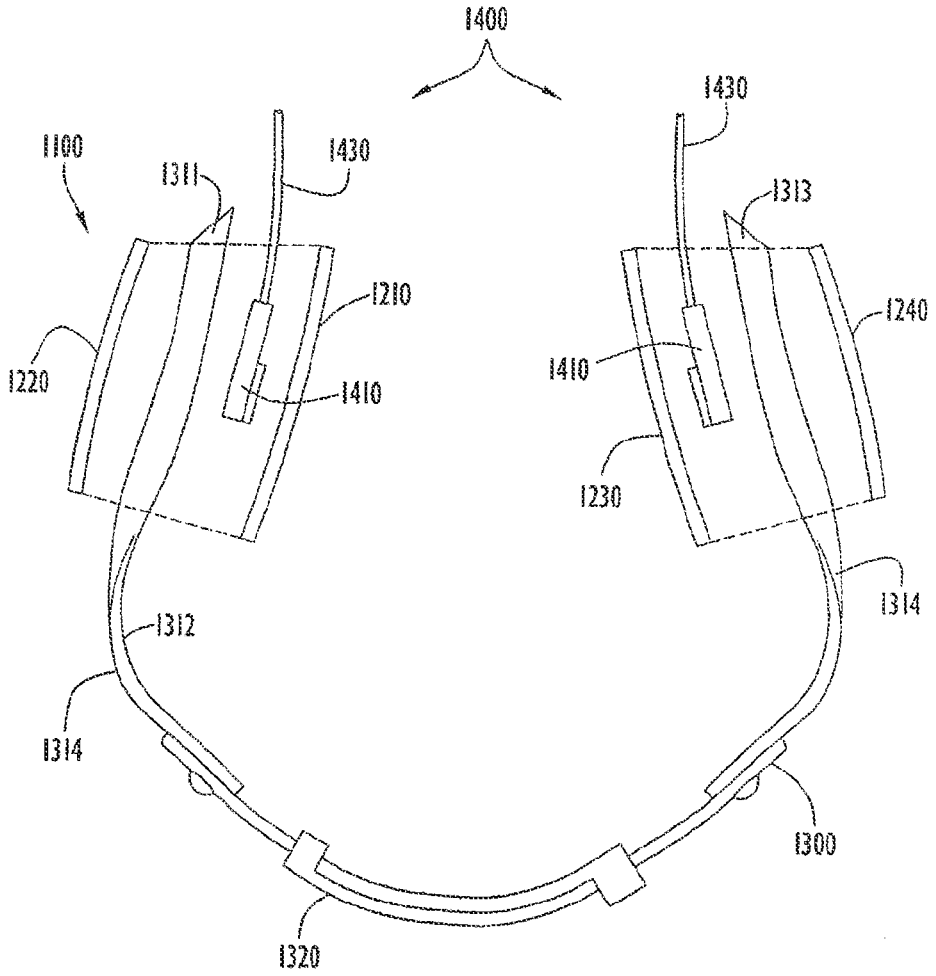
FIG. 11 is an exploded plan view of an ear covering according to an alternative embodiment of the invention.

Another embodiment of an ear covering is illustrated in FIG. 11. In this embodiment, the ear covering 1100 includes a frame member 1300, a speaker system 1400 and membranes 1210, 1220, 1230 and 1240. Frame 1300 includes a first ear portion 1311 and a second ear portion 1313. The membranes 1210-1240, for example, need not surround the frame member 1300, but may be coupled to only a portion of the frame member 1300 as illustrated. In this embodiment membrane, 1210 is coupled to at least a portion of the interior side 1312 of the frame member 1300 adjacent the first ear portion 1311 using any conventional techniques. Membrane 1220 is coupled to the membrane 1210 or to the first ear portion 1311. A receptacle is formed between membrane 1210 and membrane 1220 and is configured to receive the speaker 1410.

Membrane 1230 is coupled to the interior side 1312 of the frame 1300 adjacent the second ear portion 1313 of the frame 1300. Membrane 1240 can be coupled to membrane 1230 to form a receptacle. The receptacle is configured to receive a second speaker 1410.

Membranes 1210 and 1230 can be coupled to any portion of the interior side 1312 of the frame member 1300. For example, membranes 1210 and 1230 can be coupled around the perimeter portion of the ear portions 1311 and 1313, respectively, or may wrap around a portion of the first and second ear portions 1311 and 1313, respectively. Membranes 1210 and 1230 can alternatively be coupled to a portion of the band 1320.

Membranes 1220 and 1240 are coupled to membranes 1210 and 1230, respectively, to define receptacles for the speakers 1410 as discussed above. In one embodiment, membranes 1220 and 1240 may be, for example, coupled directly to membranes 1210 and 1230. Alternatively, membranes 1220 and 1240 can be coupled to the exterior side 1314 of the frame 1300. In this embodiment, the speaker wires 1430, the speakers 1410 and/or the connector (not shown) can be coupled to the frame member 1300 and/or the membranes 1210, 1220, 1230, 1240. In one embodiment, the membranes 1220 and 1240 wrap around a portion of the first and second ear portions 1311 and 1313, respectively.

Figure 12:
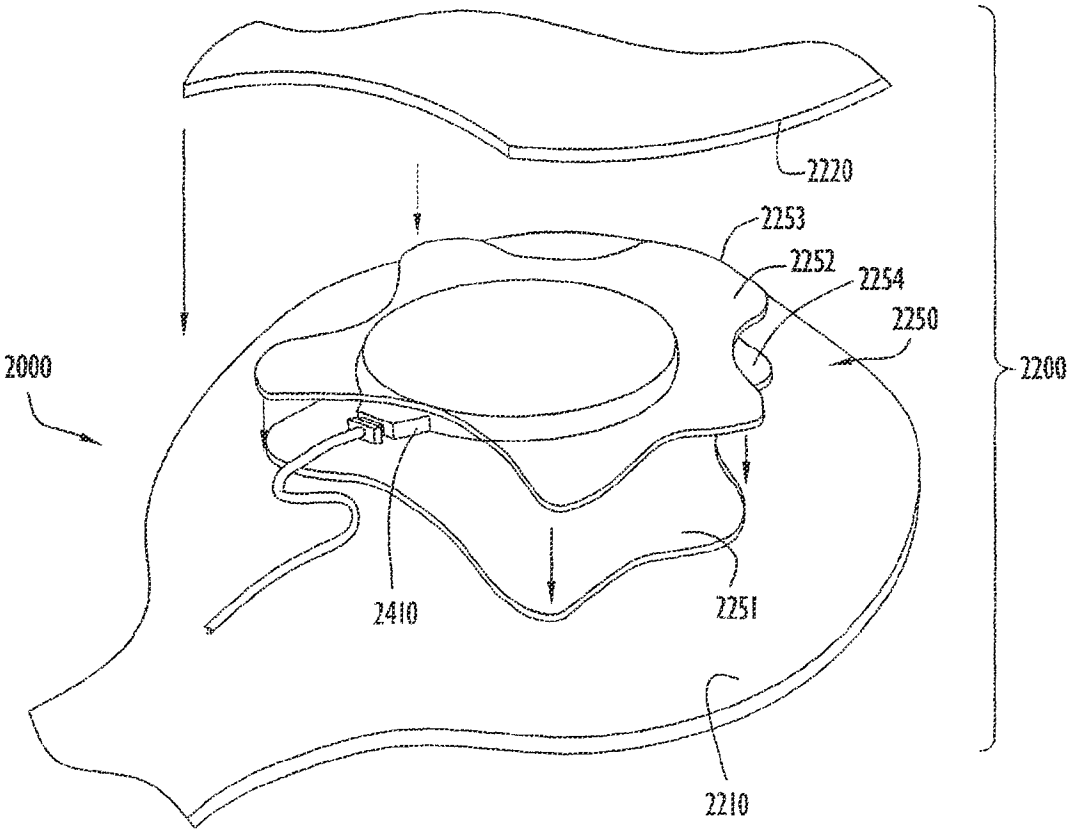
FIG. 12 is an exploded view of a portion of an ear covering according to an alternative embodiment of the invention.

In FIG. 12, another embodiment of a portion of an ear covering is illustrated. In this embodiment, the ear covering 2000 includes a membrane 2200 having a first portion 2210 and a second portion 2220. A pouch 2250 is disposed between the first portion 2210 and the second portion 2220. The pouch 2250 is configured to receive the speaker 2410.

The pouch 2250 includes a first pouch portion 2251 coupled to the first portion 2210 of the membrane 2200. The pouch 2250 further includes a second portion 2252 that is at least partially coupled to the first pouch portion 2251. The first pouch portion 2251 and the second pouch portion 2252 together define pouch receptacle configured to receive the speaker 2410. The first pouch portion 2251 and the second pouch portion 2252 of the pouch 2250 are coupled around a portion of perimeter portions of the pouch 2250. For example, the two pouch portions 2251 and 2252 may be coupled together by being coupled or tacked at various locations, such as those locations indicated by the arrows in FIG. 12, around the perimeter of the pouch 2250. The first pouch portion 2251 and the second pouch portion 2252 can be coupled to some of the other components of the membrane or covering 2000 along locations 2253 and 2254. Locations 2253 and 2254 can be disposed proximate to a perimeter portion of the membranes 2200, and sewn or coupled together. Alternatively, the pouch portions 2251 and 2252 can be coupled together by sewing, gluing, RF welding, stapling, etc.

Figure 13:
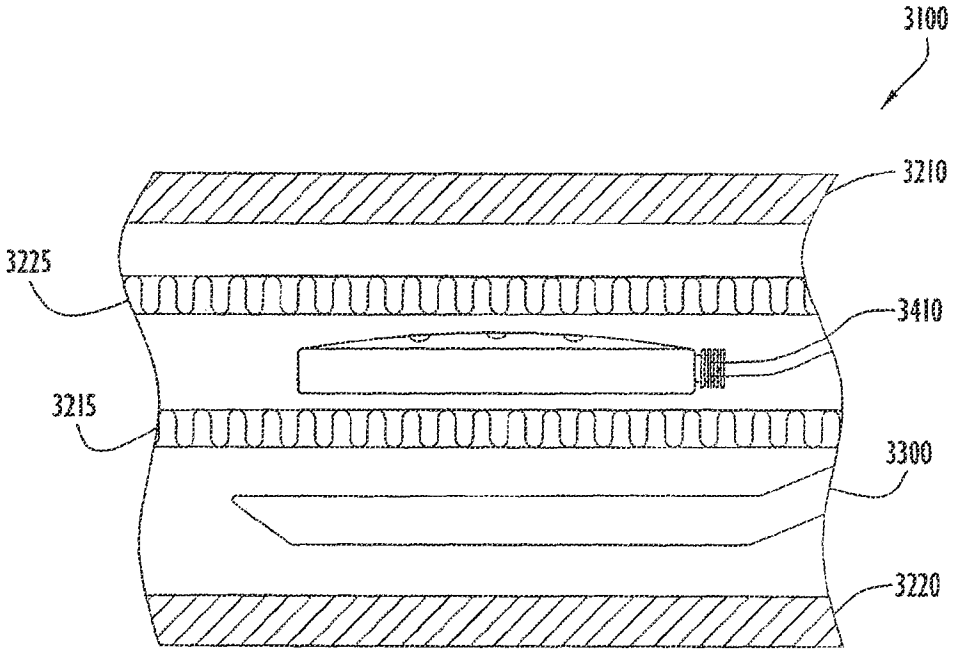
FIG. 13 is a cross-sectional view of an ear portion of an ear covering according to an embodiment of the invention.
Figure 14:
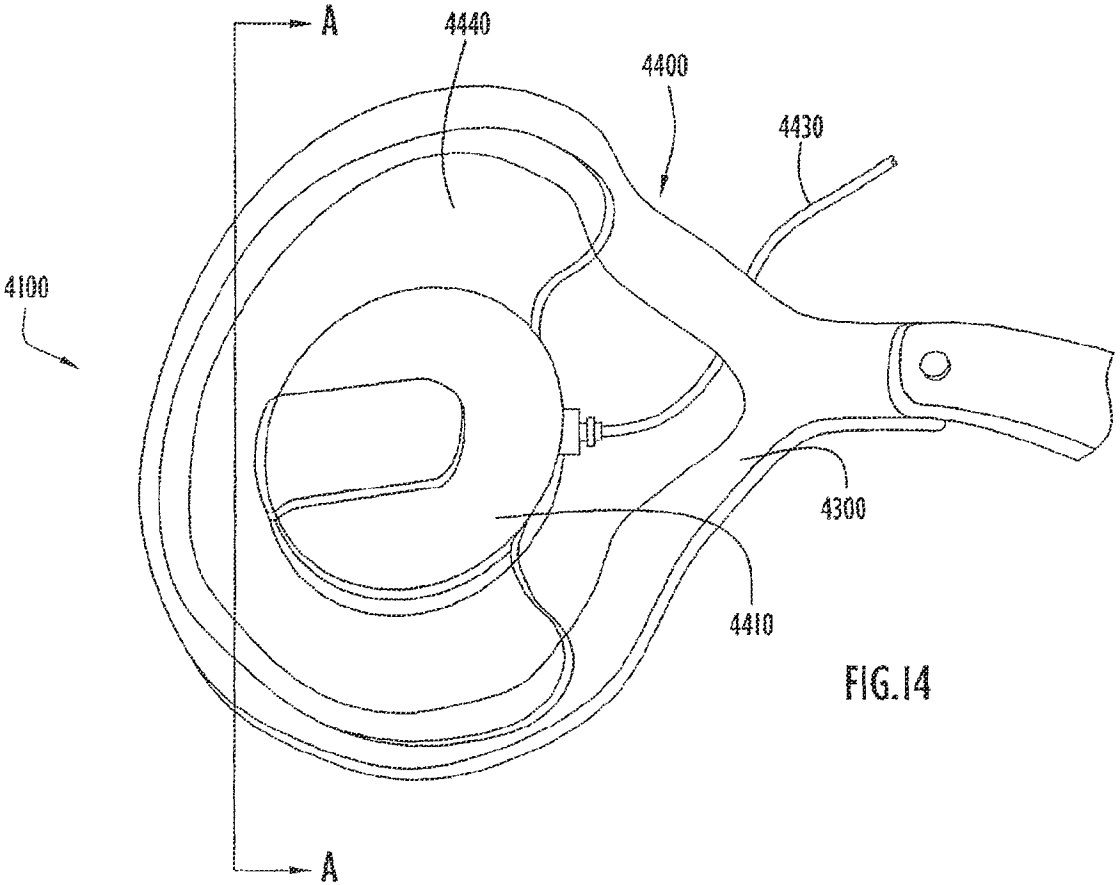
FIG. 14 is a perspective view of a portion of an ear covering according to an embodiment of the invention.

FIG. 13 is a partial cross-sectional assembly view of a portion of an ear covering according to an embodiment of the invention. The view illustrates part of the assembly of an ear portion of an ear covering 3100. The outer-most layers of the ear covering 3100 include a first membrane portion 3210 and a second membrane portion 3220. The first and second membrane portions 3210 and 3220 may be fabricated, for example, from fleece or similar material. When in a deployed configuration, the first membrane portion 3210 is in contact with a head of a user.

The speaker 3410 is retained between a breathable layer 3225, such as, for example, mesh, and a heat-retaining layer 3215, such as, for example, THERMOLITE® or similar material. A frame member 3300, such as an ear portion or member, is disposed between the outer layer 3220 and the heat-retaining layer 3215. Although not illustrated in FIG. 13, the ear covering 3100 may also include an optional weatherproof layer, such as nylon outside of the second membrane portion 3220. The ear covering 3100 may also include an optional wicking material between the breathable layer 3225 and the first membrane portion 3210.

The construction of the ear covering 3100 as discussed with respect to FIG. 13 is applicable to any of the embodiments described herein. For example, with respect to the embodiment described in relation to FIG. 2, the same orientation of components of the ear covering 100 may be utilized.

Although the layers of the ear covering have been described as being made of certain materials and providing certain functions, it is not necessary that all of the layers be present in the cover. Additionally, the different layers of the cover may provide different functions than those discussed above.

As discussed above, the various speaker assemblies may be coupled to any of the membranes. Alternatively, the speaker assemblies may be coupled to any of the frame members. Various configurations of speaker assemblies and frame attachment devices are now described.

Referring to FIGS. 14-17, a portion of a speaker assembly 4400 for use with an ear covering 4100 is shown according to an embodiment the invention. The speaker assembly includes a speaker 4410, a coupling member 4440, a wire 4430 and a connector (not shown). The speaker 4410 is coupled to the frame member 4300 via the coupling member 4440. In this embodiment, the coupling member 4440 substantially surrounds the speaker 4410 and engages the frame member 4300. In other embodiments, the coupling member need not substantially surround the speaker.

Figure 15:
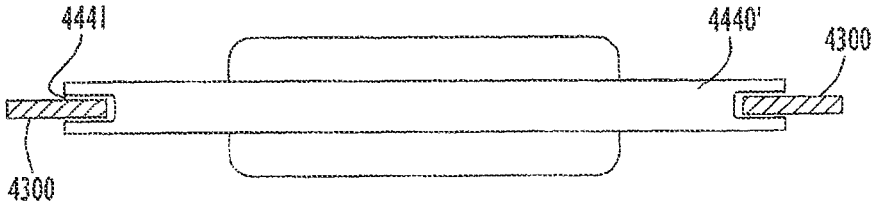
FIGS. 15-17 are cross-sectional views of the portion of an ear covering illustrated in FIG. 14 for various embodiments of a coupling member taken along the line A-A in FIG. 14.
Figure 16:
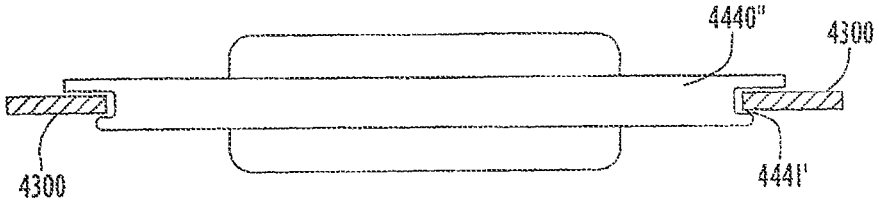
Figure 17:
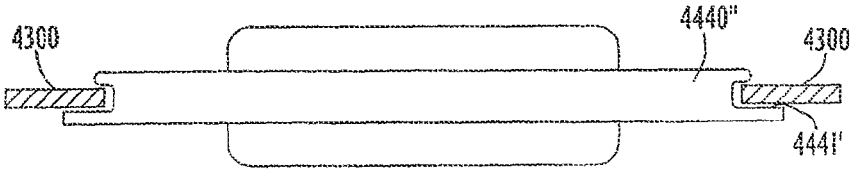

FIGS. 15-17 illustrate cross-sectional views of various embodiments of the coupling member 4440. As illustrated in FIGS. 15-17, the coupling member 4440 may engage the frame member 4300 in a variety of configurations.

More specifically, FIG. 15 illustrates a coupling member 4440' that includes a recessed groove 4441 that extends substantially around the perimeter of the coupling member 4440'. The groove 4441 is configured to receive a portion of the frame member 4300 as illustrated.

In other embodiments, the coupling member 4440" includes a cutout portion 4441' that is configured to receive a portion of the frame member 4300. The cutout portion 4441' can be located on the upper or lower side of the coupling member 4440". The coupling member 4440" may be mounted to either or both sides of the frame member 4300 as illustrated in FIGS. 16 and 17. The coupling member 4440" can be coupled to the frame member 4300 via adhesive, friction, and/or mechanical couplings. The coupling member 4440" includes an extension 4401 proximate cutout portion 4441'. The extension 4401 coupled the coupling member 4400" to frame member 4300.

Figures 20, 21:
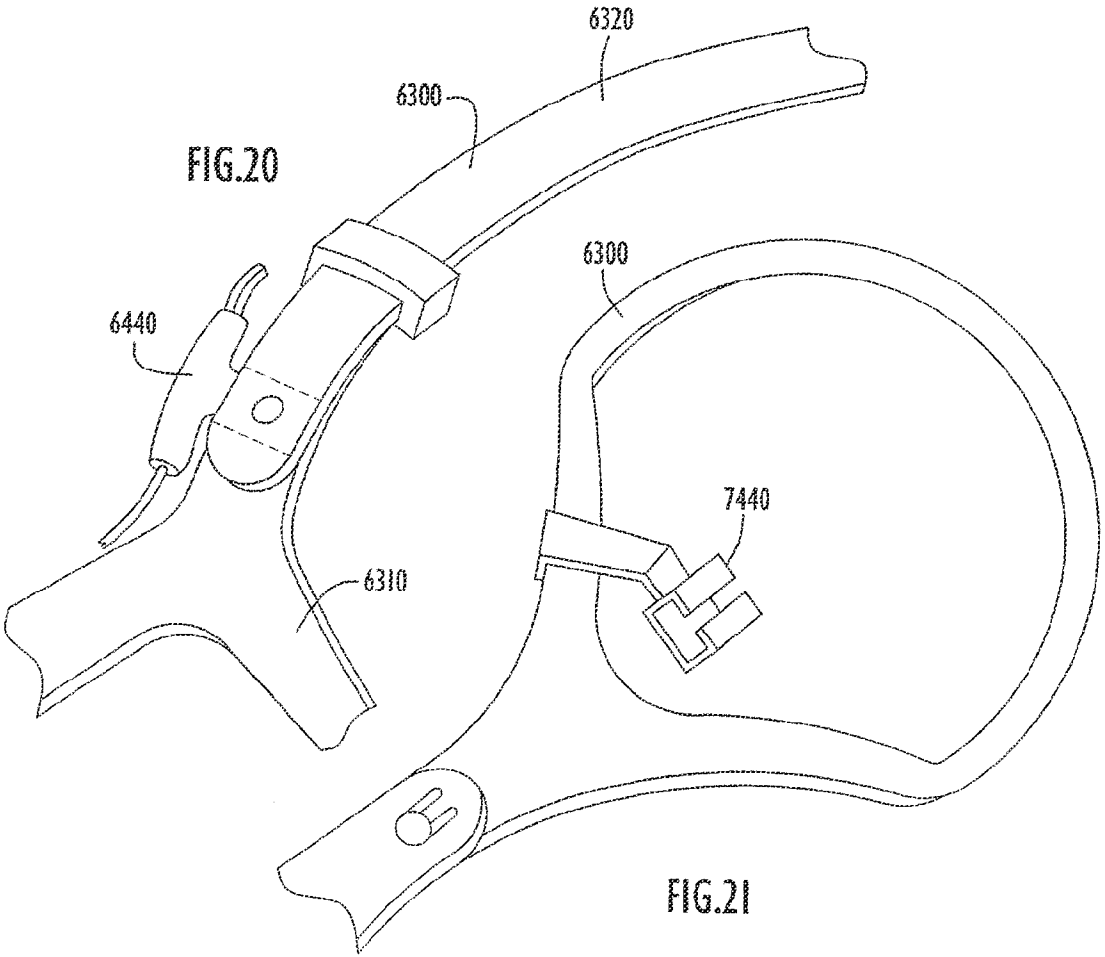
FIGS. 20-22 are perspective views of portions of an ear covering according to embodiments of the invention.
Figure 22:
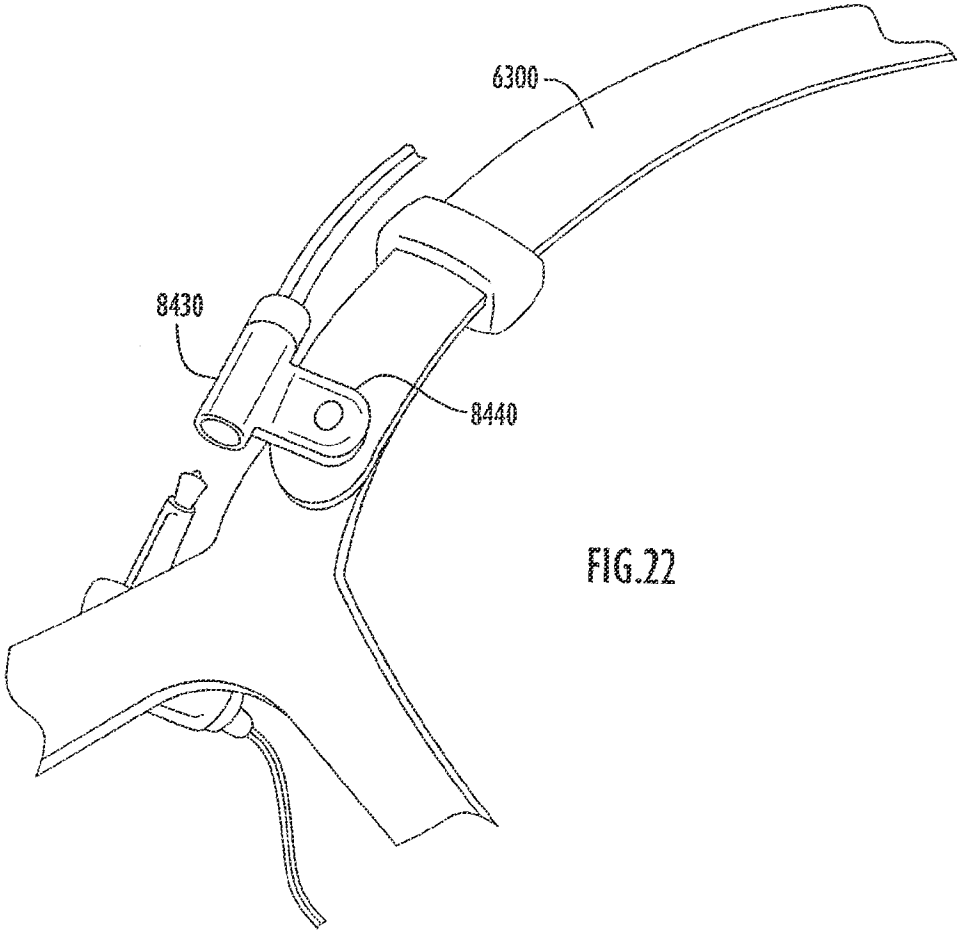

FIGS. 20-22 illustrate various coupling members 6440, 7440 and 8440, respectively, that can mount the speaker assembly to the frame member of the ear covering. For ease of reference, the frame member is illustrated as frame member 6300, but any frame member similar to those described herein can be used with the coupling members.

Coupling member 6440 illustrated in FIG. 20 is coupled at the connection between the ear portion 6310 of the frame 6300 and the band portion 6320 of the frame 6300. The coupling member 6440 is configured to couple the wire of the speaker assembly to the frame 6300. For example, by coupling the wire of the speaker assembly to the frame 6300, the connection between the wire and the speaker is protected from stress that could otherwise render the speaker inoperative.

Coupling member 7440 illustrated in FIG. 21 is configured as a clip or snap member that is configured to matingly receive a portion of the frame member 6300 as illustrated. In this embodiment, either a portion of the speaker itself or the wire can be coupled to the coupling member 7440.

FIG. 22 illustrates an embodiment in which the connector 8430 is coupled to the coupling member 8440 through monolithic construction. The coupling member 8440 can then be coupled to the frame 6300, for example, by the pivot connection.

Figure 24:
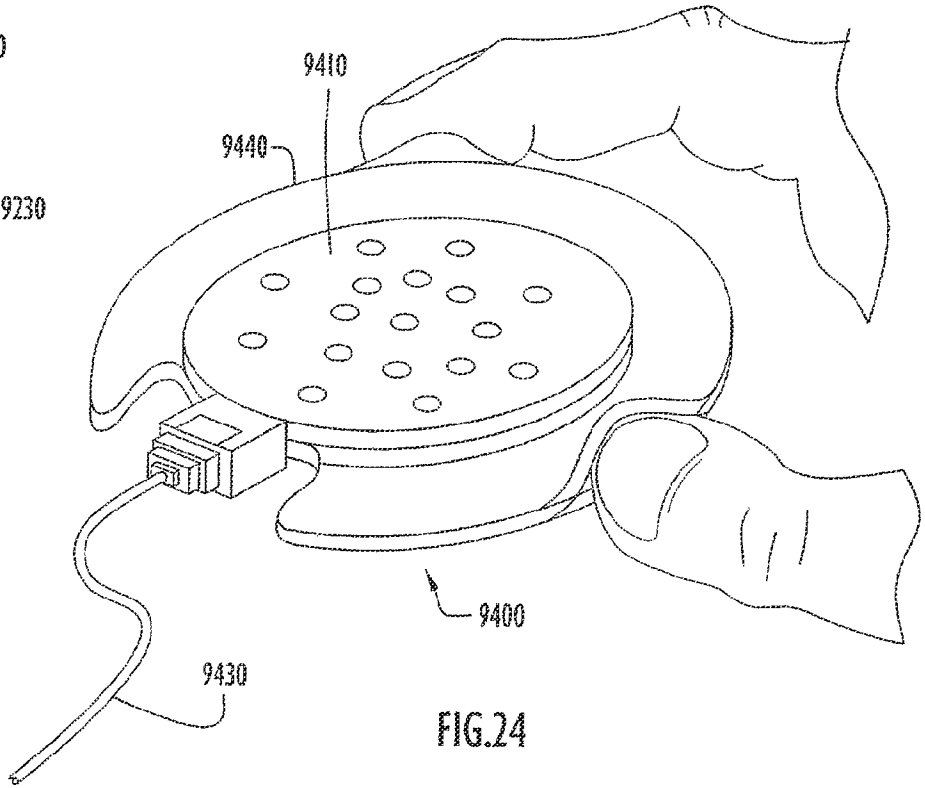
FIG. 24 is a perspective view of an embodiment of a speaker system for use with the portion of an ear covering illustrated in FIG. 23.
Figure 23:
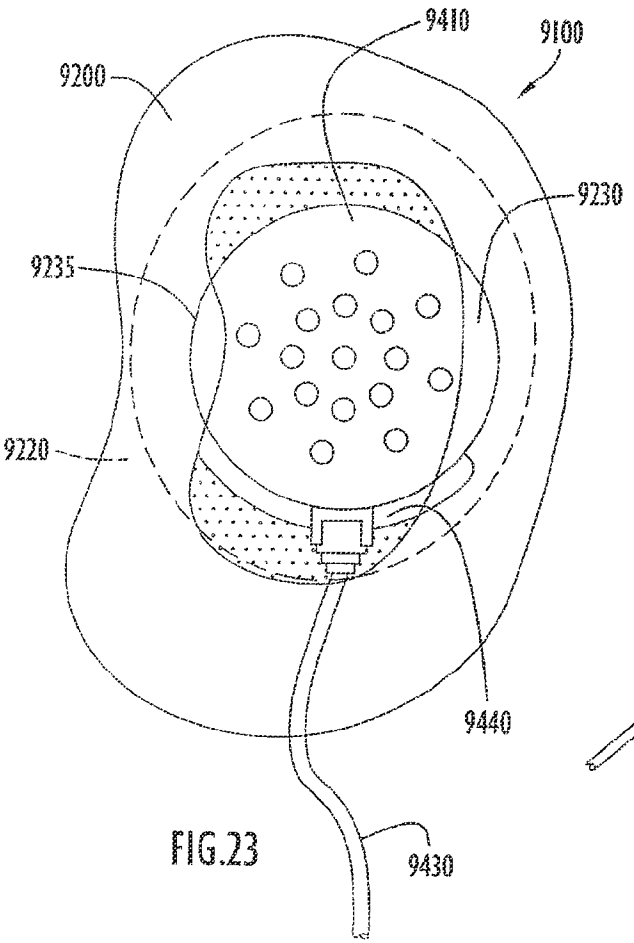
FIG. 23 is a plan view of a portion of an ear covering according to an alternative embodiment of the invention.

FIGS. 23 and 24 illustrate another embodiment of an ear covering. In this embodiment, the ear covering 9100 includes a shell 9200 configured to substantially cover and configured to receive at least a portion of an ear of a user. The shell 9200 includes a receiving portion 9235 that defines a receptacle 9220 and an opening 9230 in communication with the receptacle 9220.

Referring to FIG. 24, a speaker assembly 9400 includes a speaker 9410, a wire 9430 coupled to the speaker 9410, and a connector (not illustrated). The speaker assembly 9400 can be removably disposed within the receptacle 9220 of the shell 9200. In an alternative embodiment, the speaker assembly 9400 is fixedly coupled within the receptacle 9220. The speaker 9410 can include a coupling member 9440 similar to that described above and best shown in FIG. 24. In this embodiment, the coupling member 9440 is flexible enough such that it can be deformed and passed through the opening 9230. The coupling member 9440 is sufficiently resilient so that when a user inserts the coupling member 9440 into the shell 9200, the coupling member 9440 returns to its rest configuration and contacts an internal portion of the shell, thereby staying in place due to the size of the coupling member 9440. The wire 9430 can be passed through the opening during use or can be threaded through a separate opening (not illustrated) in the shell 9200.

Figure 25:
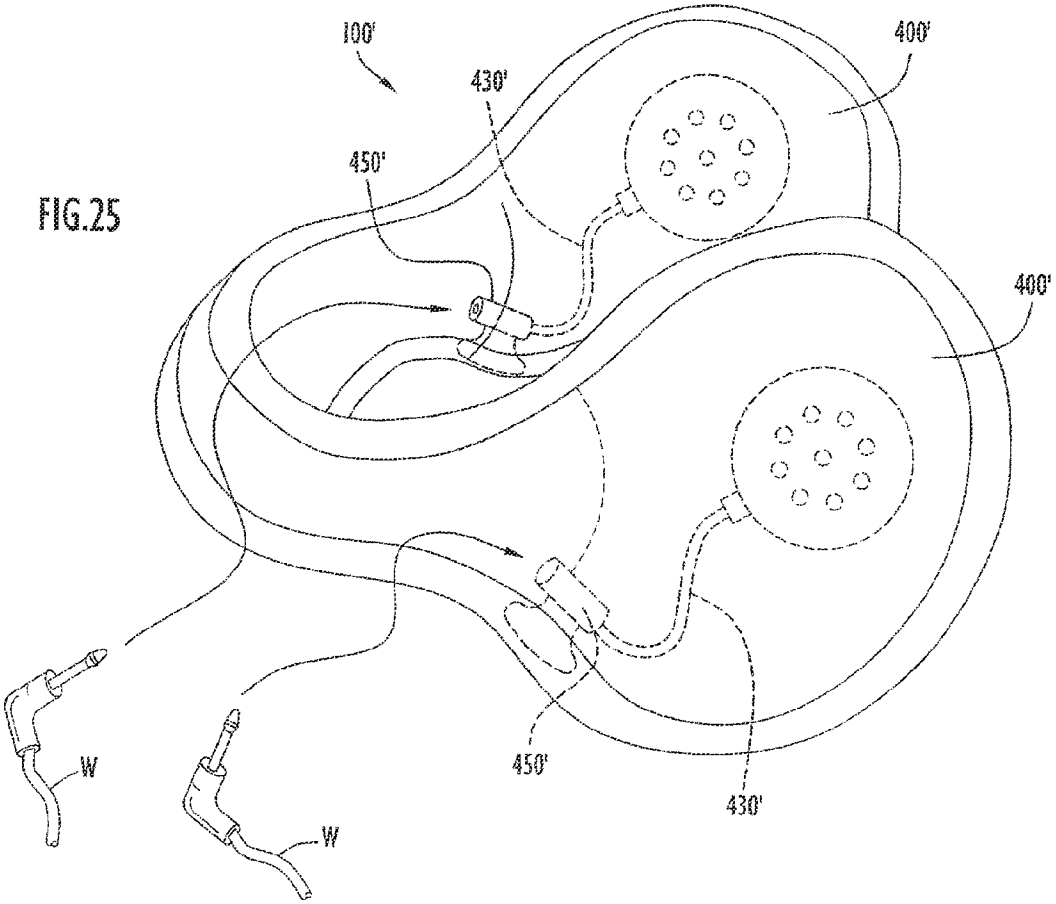
FIG. 25 is a perspective view of an ear covering according to an alternative embodiment of the invention.

In another embodiment illustrated in FIG. 25, the ear covering 100' can include separate speaker assemblies 400'. Each speaker assembly 400' can be disposed in its receptacle 220' and includes its own wire 430' and connector 450'. Each connector can be coupled to a separate wire W in use.

Any of the speaker assemblies can be utilized with any of the frames and/or connectors. Additionally, any of the membranes described above can be utilized with any of the frame members or speaker assemblies described.

Although the speaker is generally described above as being enclosed in the receptacle, in an alternative embodiment, only a portion of the speaker is enclosed. Although the wire is described above as being inside of the membrane, in an alternative embodiment, the speaker wire is woven in and out of the membrane. Although the connector of the speaker assembly is shown as a female connector, it can instead be a male connector. In such an embodiment, this male connector can mate with a female connector of a second wire having a male connector at the opposite end of the wire.

Although the speaker is generally described above as being used with an audio device, the speaker can be coupled to a cellular phone. In such an embodiment, the wire may include a microphone coupled thereto. Hence, the apparatus can be used as a hands-free cellular phone adapter.

Figure 26:
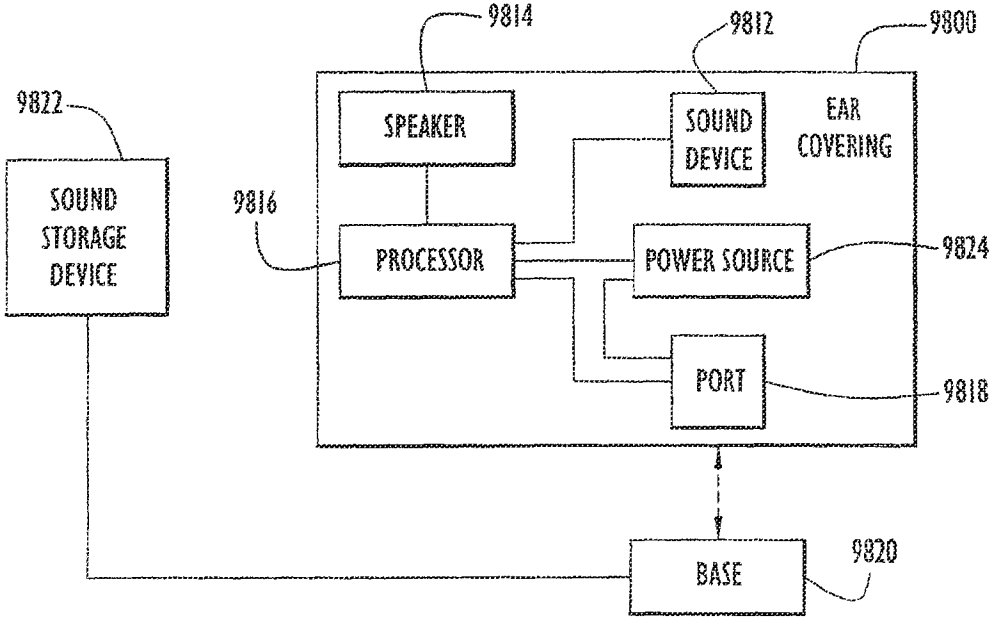
FIG. 26 is a schematic illustration of an ear covering with an internal sound device according to an embodiment of the invention.

In an alternative embodiment, the speaker is used with an internal sound-generation device, such as an MP3 player. FIG. 26 is a schematic illustration of an ear covering 9800 that includes a internal sound-generation device 9812. The sound-generation device is internal in the sense that it is entirely or at least partially disposed within an internal region formed by the fabric members. In alternative embodiments where the ear covering, for example, has a single fabric layer, the sound-generation device can be coupled to the fabric member or frame of the ear covering while being exposed or internally visible. The ear covering 9800 also includes a speaker 9814 and a processor 9816. The ear covering 9800 further includes a communication port 9818 that may be mounted or coupled to an external communication base 9820. Though the connection formed between communication port 9818 and communication base 9820 sounds, such as musical songs, may be downloaded from a sound-storage device 9822, such as a computer, to the sound-generation device 9812 of the ear covering 9800. In this embodiment, a connector (not illustrated) of the communication port 9820 is disposed proximate an opening of the ear covering 9800. Because of the size of the sound-generation device a light weight ear covering that includes a sound-generation device can be provided.

The ear covering 9800 can include a power source 9824, such as a rechargeable battery, that can be recharged when the ear covering 9800 is mounted to the base 9820. The power source 9824 provides power to the processor and other components. Alternatively, the power source can be replaceable power sources, such as batteries.

While particular, illustrative embodiments of the invention have been described, numerous variations and modifications exist that would not depart from the scope of the invention. Although the embodiments described above include certain features, any of the features described with respect to each of the embodiments are applicable for any of the embodiments.

What is claimed is:

1. An apparatus, comprising:

an ear warmer shell defining a first receptacle and a second receptacle, at least a portion of a membrane disposed between the first receptacle and the second receptacle;

an ear warmer frame, at least a portion of the ear warmer frame configured to be disposed in the first receptacle;

a first speaker configured to be disposed in the second receptacle;

a second speaker;

a connector;

a first wire electrically coupling the first speaker to the connector;

a second wire electrically coupling the second speaker to the connector; and a coupling device coupled to at least one of the first electrical wire, the second electrical wire, the connector, the first speaker, or the second speaker, the coupling device configured to be coupled to at least one of the ear warmer shell or the ear warmer frame.

2. The apparatus of claim 1, wherein the coupling device includes a tab configured to be sewn to the ear warmer shell.

3. The apparatus of claim 1, further comprising:

a third wire configured to electrically couple the connector to an audio-output jack of an electronic device.

4. The apparatus of claim 1, wherein the coupling device is a first coupling device coupled to the connector and a first portion of the ear warmer shell, the apparatus further comprising a second coupling device coupled to the second electrical wire and a second portion of the ear warmer shell.

5. The apparatus of claim 1, wherein the ear warmer frame is removable from the first receptacle without removing the first speaker from the second receptacle.

6. The apparatus of claim 1, wherein the first speaker is removable from the second receptacle without removing the ear warmer frame from the first receptacle.

7. An apparatus, comprising:

a speaker;

a wire configured to be electrically coupled to the speaker;

an ear warmer frame;

a coupler configured to removeably couple the wire to the ear warmer frame; and a membrane coupled to the ear warmer frame.

8. The apparatus of claim 7, further comprising an ear warmer shell including the membrane, at least a portion of the ear warmer frame disposed within an interior region of the ear warmer shell.

9. The apparatus of claim 7, wherein the speaker is a first speaker, the wire is a first wire, the apparatus further comprising:

a connector, the first wire electrically coupling the first speaker to the connector;

a second speaker;

a second wire electrically coupling the second speaker to the connector; and a second coupler configured to removeably couple the second wire to the ear warmer frame.

10. The apparatus of claim 7, further comprising an ear warmer shell, wherein at least a portion of the ear warmer frame is configured to be disposed within an interior region of an ear warmer shell, the ear warmer shell including the membrane, the ear warmer frame configured to be coupled to the ear warmer shell independent of the speaker.

11. The apparatus of claim 7, further comprising an ear warmer shell, the ear warmer shell defining a first receptacle and a second receptacle, the membrane disposed between the first receptacle and the second receptacle, the first receptacle configured to receive the speaker, the second receptacle configured to receive a portion of the ear warmer frame.

12. The apparatus of claim 7, further comprising an ear warmer shell including the membrane, the ear warmer shell defining an opening, the speaker configured to be removable from the ear warmer shell via the opening.

13. An apparatus comprising:

an ear warmer frame;

a speaker;

a wire electrically coupled to the speaker; and a coupling device removeably coupled to the ear warmer frame and coupled to at least one of the speaker or the wire, the coupling device configured to limit movement of the at least one of the speaker or the wire relative to the ear warmer frame when the coupling device is coupled to the ear warmer frame, the speaker removable from the ear warmer frame when the coupling device is decoupled from the ear warmer frame.

14. The apparatus of claim 13, further comprising a membrane removeably coupled to the ear warmer frame, when the coupling device is decoupled from the ear warmer frame, the speaker removable from the ear warmer frame while the membrane is coupled to the ear warmer frame.

15. The apparatus of claim 13, wherein the coupling device is coupled directly to the wire, the coupling device not directly coupled to the speaker.

16. The apparatus of claim 13, wherein the speaker is configured to be disposed within a first receptacle defined by an ear warmer shell, the speaker is a first speaker, and the wire is a first wire, the apparatus further comprising:

a second speaker configured to be disposed in a second receptacle defined by the ear warmer shell; and a second wire, the second wire electrically coupling the second speaker to at least one of the first speaker or the first wire.

17. The apparatus of claim 13, wherein the speaker is first speaker, the wire is a first wire, and the coupling device is a first coupling device configured to be coupled to a first portion of the ear warmer frame, the apparatus further comprising:

a second speaker;

a second wire electrically coupled to the second speaker; and a second coupling device removeably coupled to a second portion of the ear warmer frame and coupled to at least one of the second speaker or the second wire, the second coupling device configured to limit movement of the at least one of the second speaker or the second wire relative to the ear warmer frame when the second coupling device is coupled to the ear warmer frame, the second speaker removable from the ear warmer frame when the second coupling device is decoupled from the ear warmer frame, the second speaker removable from the ear warmer frame independently of the first speaker.

18. The apparatus of claim 13, wherein the coupling device is removeably coupled to the at least one of the speaker or the wire.

19. The apparatus of claim 13, further comprising a membrane removeably coupled to an ear portion of the ear warmer frame, the ear warmer frame collectively configured to be worn about a portion of a head when the speaker is removed from the ear warmer frame.

20. The apparatus of claim 13, further comprising an ear warmer shell, at least a portion of the ear warmer frame configured to be disposed within the ear warmer shell.

* * * * *